US010647389B2

(12) United States Patent
Bryant et al.

(10) Patent No.: US 10,647,389 B2
(45) Date of Patent: May 12, 2020

(54) ROTATING AND SLIDING BOARDING DOOR ASSEMBLY SYSTEMS FOR A VESSEL AND A VESSEL HAVING THE SAME

(71) Applicant: The Hinckley Company, Portsmouth, RI (US)

(72) Inventors: Scott Bryant, Portsmouth, RI (US); Keith Attee, Ellsworth, MI (US); Tom Buerkle, Ellsworth, MI (US)

(73) Assignee: The Hinckley Company, Portsmouth, RI (US)

( * ) Notice: Subject to any disclaimer, the term of this patent is extended or adjusted under 35 U.S.C. 154(b) by 0 days.

(21) Appl. No.: 16/042,704

(22) Filed: Jul. 23, 2018

(65) Prior Publication Data

US 2019/0100285 A1 Apr. 4, 2019

Related U.S. Application Data

(60) Provisional application No. 62/604,816, filed on Jul. 21, 2017.

(51) Int. Cl.

| | |
|---|---|
| ***B63B 19/08*** | (2006.01) |
| ***B63B 17/04*** | (2006.01) |
| ***B63B 19/18*** | (2006.01) |
| *B63B 27/00* | (2006.01) |
| *B63B 19/00* | (2006.01) |

(52) U.S. Cl.

CPC ..... *B63B 19/08* (2013.01); *B63B 17/04* (2013.01); *B63B 19/18* (2013.01); *B63B 27/02* (2013.01); *B63B 2019/0053* (2013.01); *B63B 2019/0069* (2013.01); *B63B 2707/00* (2013.01)

(58) Field of Classification Search

CPC ..... B63B 19/08; B63B 19/18; B63B 17/04; B63B 27/02; B63B 2019/0053; B63B 2707/00

See application file for complete search history.

(56) References Cited

U.S. PATENT DOCUMENTS

| | | | | |
|---|---|---|---|---|
| 5,191,854 | A * | 3/1993 | Lehmann | B63B 19/08 114/291 |
| 5,450,807 | A * | 9/1995 | Moody | B63B 19/08 114/202 |
| 2010/0170430 | A1* | 7/2010 | Gros | B63B 19/08 114/362 |
| 2012/0285357 | A1* | 11/2012 | Gros | B63B 19/08 114/203 |
| 2015/0232151 | A1* | 8/2015 | Fuller, IV | B63B 19/18 114/117 |
| 2018/0057111 | A1* | 3/2018 | Allender | B63B 3/48 |

* cited by examiner

*Primary Examiner* — Stephen P Avila
(74) *Attorney, Agent, or Firm* — Prince Lobel Tye LLP

(57) ABSTRACT

The present invention relates to a rotating and sliding boat boarding door mechanism configured to aid the vessel's occupants in their ingress and egress to and from the vessel. More particularly, the present invention provides a rotating and sliding boat boarding door assembly and system that slidingly moves into a recess in the vessel's exterior (e.g., side, transom, and/or gunwale) that has been configured to receive and maintain the boarding door assembly in a position where it is out of sight when fully recessed.

22 Claims, 29 Drawing Sheets

ROTATING AND SLIDING BOARDING DOOR ASSEMBLY SYSTEMS FOR A VESSEL AND A VESSEL HAVING THE SAME

FIELD OF THE INVENTION

The present invention generally relates to boarding doors for a vessel, such as a recreational boat or yacht, configured to aid the vessel's occupants in their ingress and egress to and from the vessel. More specifically, the present invention relates to a rotating and sliding boat boarding door assembly and system that slides into a recess in the vessel's exterior (e.g., side, transom, and/or gunwale) that has been configured to receive and maintain the boarding door assembly in a position where it is out of sight when fully recessed.

BACKGROUND OF THE INVENTION

The dimensions of the opening (e.g., passageway) through the sidewall of a vessel (e.g., a gunwale) govern the accessibility and therefore the easy in which an individual and cargo can traverse on and off a marine vessel. The passageway is limited by the height of the opening and the width of the opening. The height is limited by the distance between decks on multi decked vessels. The width is limited by the horizontal distance across the opening. The opening is commonly governed by the respective size of a doorway.

The ship building industry is familiar with many types of sliding and swinging door assemblies and other means for obtaining access to the vessel's deck and interior spaces. A few examples of these door and boarding devices include, companionway doors, and various folding ladders and stairs as well as retractable gangways. Typically, swinging boat doors are limited to standardly affixed and hinged designs for single doors and/or multipart doors that swing back and forth to allow access to the vessel.

Hinged boat doors require a clearance for opening. This limitation can introduce complications in the design requirements as the doors are typically pivotally cantilevered on one side by one or more hinges. This configuration can introduce several challenges for the marine engineer to consider. For example, standard hinged boat door assemblies can create undesired strains on supporting structures as well as necessitate accommodation of the hinge and closures mechanisms, and finally, hinged doors require sufficient clearances to open and close. The necessary design allowances can intrude upon the vessel's available interior deck space as well as reduce the opening dimensions. The design aesthetics of the vessel that are very important in high end and luxury marine vessels (e.g., pleasure boats, yachts, cruise ships, and the like) markets for can also be adversely impacted by these design accommodations.

Aside from hinged doors, some other vessel designs include sliding doors between the exterior deck of the vessel and the cabin interior. A sliding door is often preferred over a hinged types of boat doors because of space requirements and the negative implications of a hinged door suddenly swinging in either direction due to rolling seas. Indeed, a swinging door could severely injure one person while he or she is trying to enter or exit through such door when the rolling of the vessel due to rough seas suddenly swings the door toward the person.

Pocket sliding doors are sliding doors in which at least a portion of the door is withdrawn into an enclosure. Such doors are well known in residential housing and offices, and have also been used in vessels where swinging doors are undesirable. Pocket doors are usually straight, however, it is known to use curved pocket doors in corner cabinets, furniture, and the like.

Pocket doors could potentially be used in a boat transom or other external positions on a boat, but they would be limited. For instance, known pocket door designs are usually hung from above and/or supported from below and therefore require one or more stabilizing tracks, rollers, and guide systems, that run the length of the path of the door. Nevertheless, one or more tracks crossing the opening of the boat's transom would be undesirable for a number of reasons, including but not limited to, the tracks would diminish from the design aesthetic, they would tend to fill with water and other debris, and it could even comprise a danger during ingress and egress. These problems would be exacerbated for boats having a door in a curved, angled, or complex cross sectioned transom and/or gunwale. Such doors would have to be similarly shaped as well, which would be especially hard to implement without existing track technologies across the opening.

There are number of conventional boat boarding door systems. However, none provide a pivoting and sliding boat door boarding system that can be opened and closed without altering the original height, shape, and design aesthetic of the vessel's exterior (e.g., gunwale) while providing easy entry to the vessel's deck and interior spaces.

SUMMARY OF THE INVENTION

The present invention relates to a rotating and sliding boat boarding door mechanism configured to aid the vessel's occupants in their ingress and egress to and from the vessel. More particularly, the present invention provides a rotating and sliding boat boarding door assembly and system that slidingly moves into a recess in the vessel's exterior (e.g., side, transom, and/or gunwale) that has been configured to receive and maintain the boarding door assembly in a position where it is out of sight when fully recessed.

The several advantages of the rotating and sliding boat boarding doors make these door assemblies and systems particularly applicable to incorporation in a variety of marine vessel designs and build-outs including, but not limited to, high-end and luxury vessels such as pleasure boats, yachts, and cruise ships, and the like, as well as utility and commercial vessels such as cargo ships and freighters, fishing boats, ferries, runabouts, tug boats, firefighting vessels, law and harbor patrol vessels, Coast Guard and military vessels, and the like.

In preferred embodiments, the rotating and sliding boat boarding door assemblies and systems (i.e., boarding doors) when fully opened and the boarding door is in the retracted position provides an unobstructed deck/transit surface for easy ingress and egress to and from the vessel across the opening.

In other preferred embodiments, the rotating and sliding boat boarding door assemblies and systems provide a level transit surface (e.g., walking surface) for better ingress and egress to and from the vessel. In some of these embodiments, the transit surface is at a slight inclination or declination (depending on direction of transit) relative to the deck in order to compensate for any changes in deck surface levels or protrusions across the threshold of the opening and/or to assist in ingress and egress to and from the vessel. In still some other of these embodiments, the transit surface is configured with one or more means to prevent and/or limit the vessel's occupants from slipping while traversing the opening/threshold (i.e., anti-slip paint or abrasives).

In other embodiments, the rotating and sliding boat boarding door assemblies and systems provide one or more outermost panels that when fully closed form a substantially smooth vertical outer vessel surface (e.g., transom, gunwale, side of the vessels, and/or the deck, and the like). Similarly, in other of these embodiments, the inside (i.e., cabin or interior facing surface) surface of the rotating and sliding boat boarding door assemblies and systems provide one or more innermost panels that when fully closed form a substantially smooth vertical inner vessel surface (e.g., transom, gunwale, side of the vessels, and/or the deck, and the like). In still other of the embodiments, the rotating and sliding boat boarding door assemblies and systems provide one or more topmost panels that when fully closed form a substantially smooth horizontal (top) vessel surface (e.g., transom, gunwale, side of the vessels, and/or the deck, and the like) and/or provide railing elements aligned to form continuous railing spans.

The rotating and sliding boat boarding door assemblies and systems of the present invention can be designed to fit anywhere on the exterior of the boat typically considered for occupant ingress and egress, for example, along the transom, along a side of the boat, or leading into an interior space in the boat (e.g., bridges, boathouses, cabins, holds, and the like).

It is contemplated that significant portions of the inventive rotating and sliding boat boarding door assemblies and systems of the present invention can be constructed or formed out of virtually any suitable waterproof or water resistant homogenous or polymeric material(s) and made to any practical size or shape, suitable materials include, any suitable construction material or combination of construction materials including, but not limited to, steel, aluminum, titanium, and marine grade alloys of these and/or other metals, carbon fiber panels, and other composite materials, fiberglass, and other fiber reinforced and/or non-fiber reinforced resin products, solid woods, veneered wood products, and laminated wood products, and plastics. In certain preferred embodiments, the rotating and sliding boat boarding door panel assemblies and systems of the present invention are manufactured from fiberglass or other waterproof polymeric material(s).

In some embodiments, the rotating and sliding boat boarding door assemblies and systems of the present invention are substantially sealed from water infiltration across the edges when fully seated and held in the closed position. One or more commonly known gasket or sealing materials (e.g., natural and/or synthetic, hydrophobic compositions, latexes, silicones, and silicone impregnated materials, and the like) fashioned into seals, caulks, beads, weep holes and channels, and the like, may be optionally used to provide the desired level of water resistance across the door seal.

In certain embodiments, preferred rotating and sliding boat boarding door assemblies and systems, and hence the corresponding door openings, are about one or more meter(s) long (e.g., 0.5, 0.75, 1.0, 1.25, 1.5, 1.75, 2.0, 2.25, 2.5, 2.75, 3.0, 3.25, 3.5, 3.75, 4.0, 4.25, 4.5, 4.75, to 5.0, 5.25, 5.5, 5.75, 6.0 m or more meters and dimensions encompassed therein) and about one-half or more meter(s) tall (e.g., 0.5, 0.75, 1.0, 1.25, 1.5, 1.75, 2.0, 2.25, 2.5, 2.75, 3.0, 3.25, 3.5, 3.75, 4.0, 4.25, 4.5, 4.75, to 5.0, 5.25, 5.5, 5.75, 6.0 m or more meters and dimensions encompassed therein).

One embodiment of the present invention provides for a single rotating and sliding boat boarding door assembly and system installed to form the desired opening, wherein the boarding door slides towards the bow, or alternatively, slides towards the stern of the vessel (when the door is mounted on the gunwale/vessel side).

In another embodiment, two rotating and sliding boat boarding door assemblies and systems are installed to form the desired opening, wherein a first boarding door slides towards the bow, and the second, slides towards the stern of the vessel (when the doors are mounted on the gunwale/vessel side). Accordingly, in some embodiments, the sliding boat boarding door assemblies and systems of the present invention can be used in pairs, where the doors approximate one another at their leading edges. One or more detents can be placed on a leading edge of one or more doors, possibly with corresponding indentations in an approximating surface. Sliding doors are contemplated to be straight or curved.

The rotating and sliding boat boarding door assemblies and systems can be operated in any suitable manner including, but not limited to, implementing one or more of the following: manual operation by winches, cranks, levers, and the like; by electrical motors; by hydraulic jacks, pistons, and/or actuators; by other fluidic or pneumatic jacks, pistons, and/or actuators; by mechanical actuators powered by or implemented with any of the forgoing sources and additionally including, but not limited to, gears, pinions, tracks, rollers, alignment guides, travelers, sleeved and and/or concentric sliding sections, springs, pistons, dampers, cables, chains, pulley systems, screw drives, linkages, armatures, raceways and bearings, swivels, hinges and rotating pivot points, catches, palls; and optionally, one or more, motor and/or motion arrestors, movement and tension sensors, electronic eye and break beam detectors, safety stops, and/or anti-crush mechanisms, locking and security devices, safety sensors and/or inputs, and suitable operational controls.

In certain preferred embodiments, some of the rotating and sliding boat boarding door assemblies and systems comprise one or more sub-assemblies. In one such particularly preferred embodiment, the rotating and sliding boat boarding door assembly and systems comprises an outer vessel wall panel section that is operably, and preferably slidingly, linked to a rotating and sliding an inner vessel wall section, and optionally, one or both further being operably linked to a flexible (e.g., articulated) transit surface.

The inner wall section can take any form that roughly imitates the general cross section of the vessel's sidewall and/or deck, and/or gunwale, and/or railing, and the like (as illustrated in the Figures). The inner wall section, in some preferred embodiments, is configured in roughly an "L" shape (i.e., provided in a right angle configuration, as illustrated in the Figures). It is further contemplated, in preferred embodiments, that the outer vessel wall panel section is capable of movement in one or more planes (i.e., X and Y, X and Z, or Z and Y) and most preferable in its X plane/axis (e.g., sliding motion about this axis) and its Y plane/axis (e.g., sliding motion about this axis). It is further contemplated that the inner wall section is capable of movement about its transverse plane, or X plane/axis, (e.g., rotational movement about this axis) as well as motion its Y plane/axis (e.g., sliding motion about this axis).

In preferred embodiments the vessel's sidewall and/or transom where one or more of the rotating and sliding boat boarding door assemblies and systems have been installed, has sufficient space (width) when considered in cross section to receive the retracted inner wall section, and more preferable, additionally the outer vessel wall panel section, and even more preferably, additionally the transit surface as well, at the termination of these sub-assemblies sliding/ rotational movements and retraction into the sidewall(s) and/or gunwale(s) of the vessel.

Unless otherwise defined herein, technical terms used in connection with the present invention shall have the meanings that are commonly understood by those of ordinary skill in the art. The meaning and scope of the terms should be clear, however, in the event of any latent ambiguity, definitions provided herein take precedent over any dictionary or extrinsic definition. Further, unless otherwise required by context, singular terms shall include pluralities and plural terms shall include the singular. In this application, the use of "or" means "and/or" unless stated otherwise. Furthermore, the use of the term "including", as well as other forms, such as "includes" and "included", is not limiting. Also, terms such as "element" or "component" encompass both elements and components comprising one unit and elements and components that comprise more than one subunit unless specifically stated otherwise.

Generally, nomenclatures used in connection with, and techniques of mechanical and naval engineering described herein are those well-known and commonly used in the art.

DETAILED DESCRIPTION OF THE INVENTION

The present invention relates to a rotating and sliding boat boarding door mechanism configured to aid the vessel's occupants in their ingress and egress to and from the vessel. More particularly, the present invention provides a rotating and sliding boat boarding door assembly and system that slidingly moves into a recess in the vessel's exterior (e.g., side, transom, and/or gunwale) that has been configured to receive and maintain the boarding door assembly in a position where it is out of sight when fully recessed.

The present invention relates to the rotating and sliding boat boarding door assemblies and systems as illustrated in the Figures and as further described herein.

Figure 1:
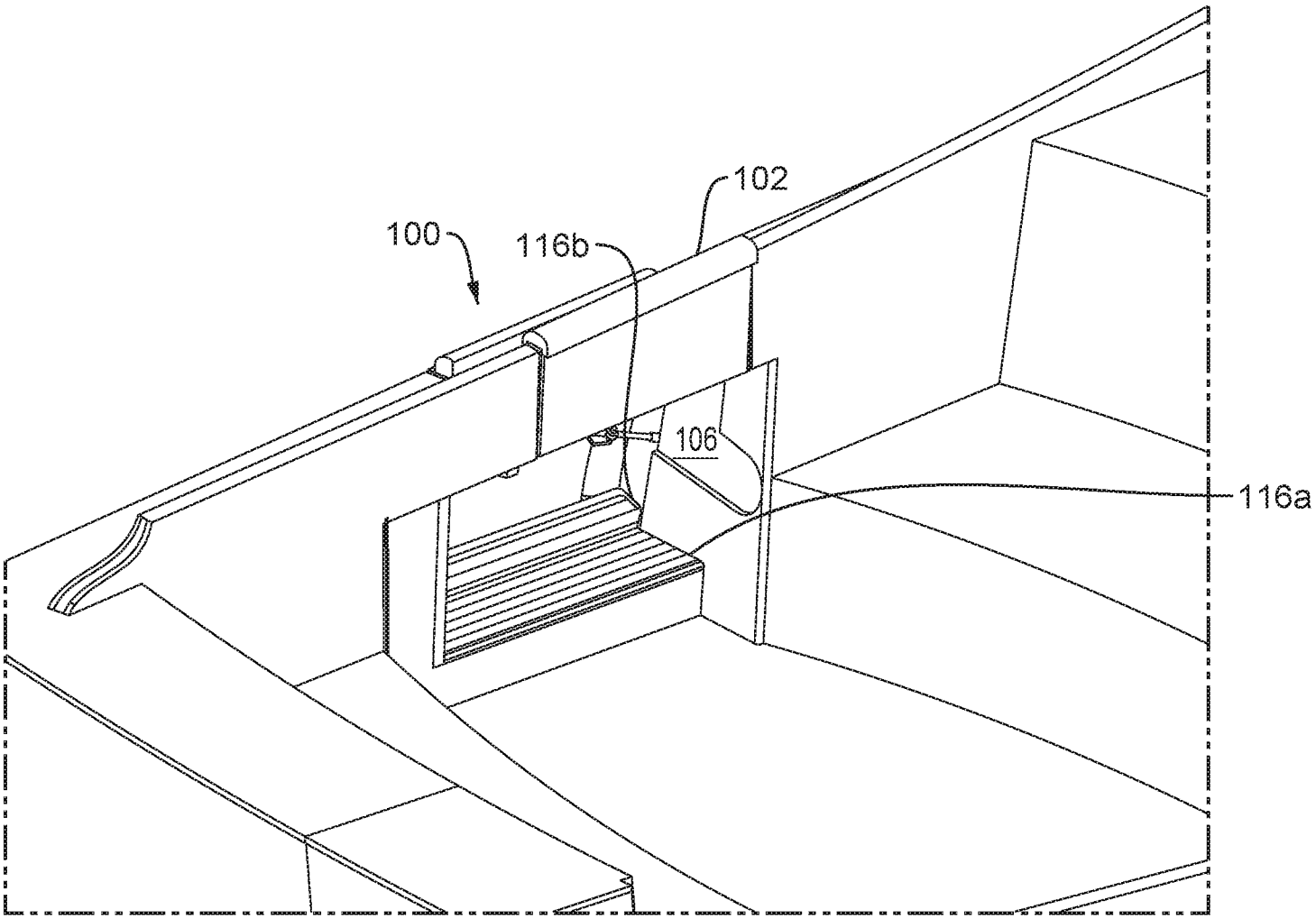
FIG. 1 is an aerial aft perspective view from inside the vessel according to an embodiment of the present invention.
Figure 13:
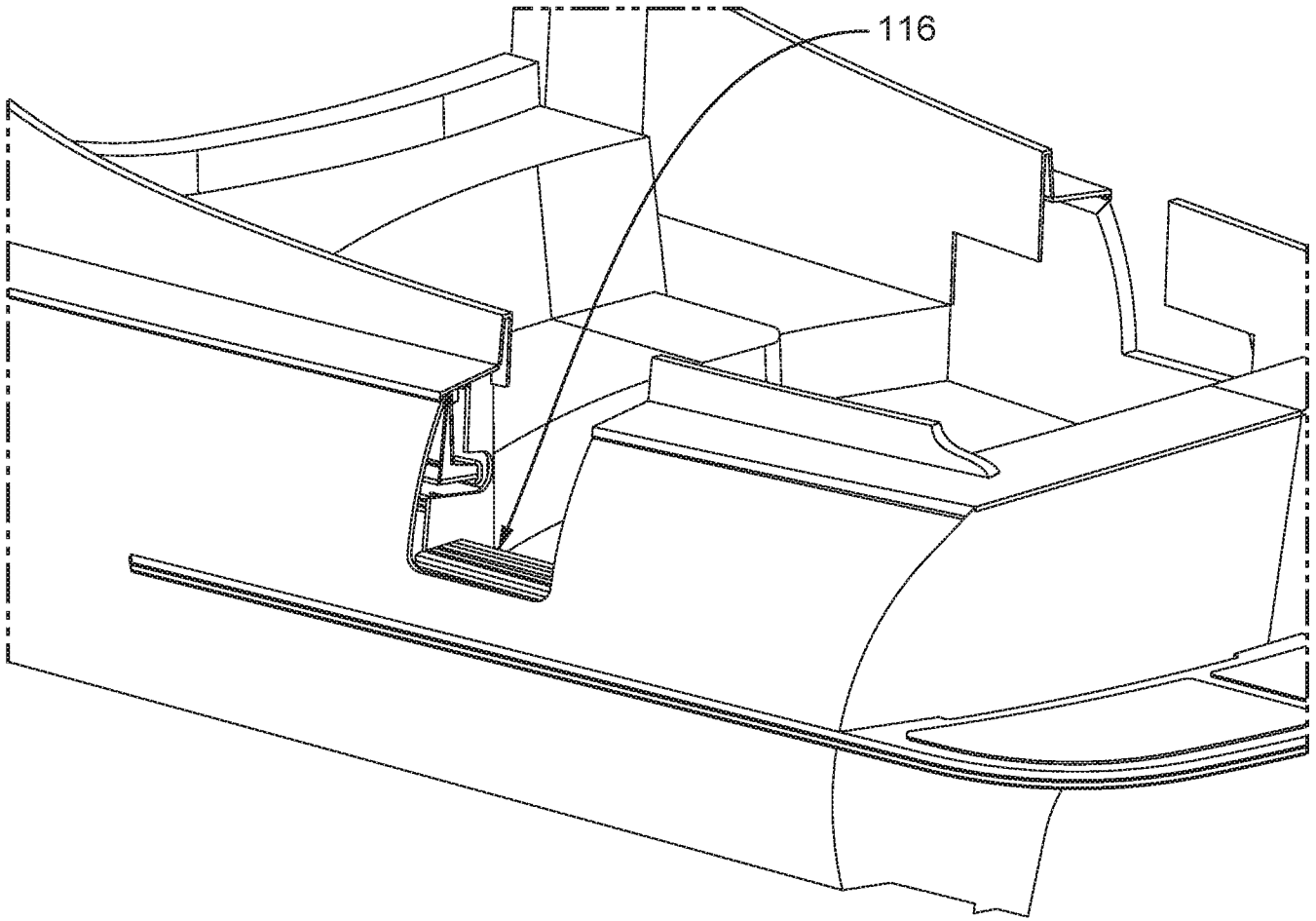
FIG. 13 is an aerial port perspective view from outside the vessel providing a partial cutaway view of the vessels' sidewall/gunwale according to an embodiment of the present invention.
Figure 14:
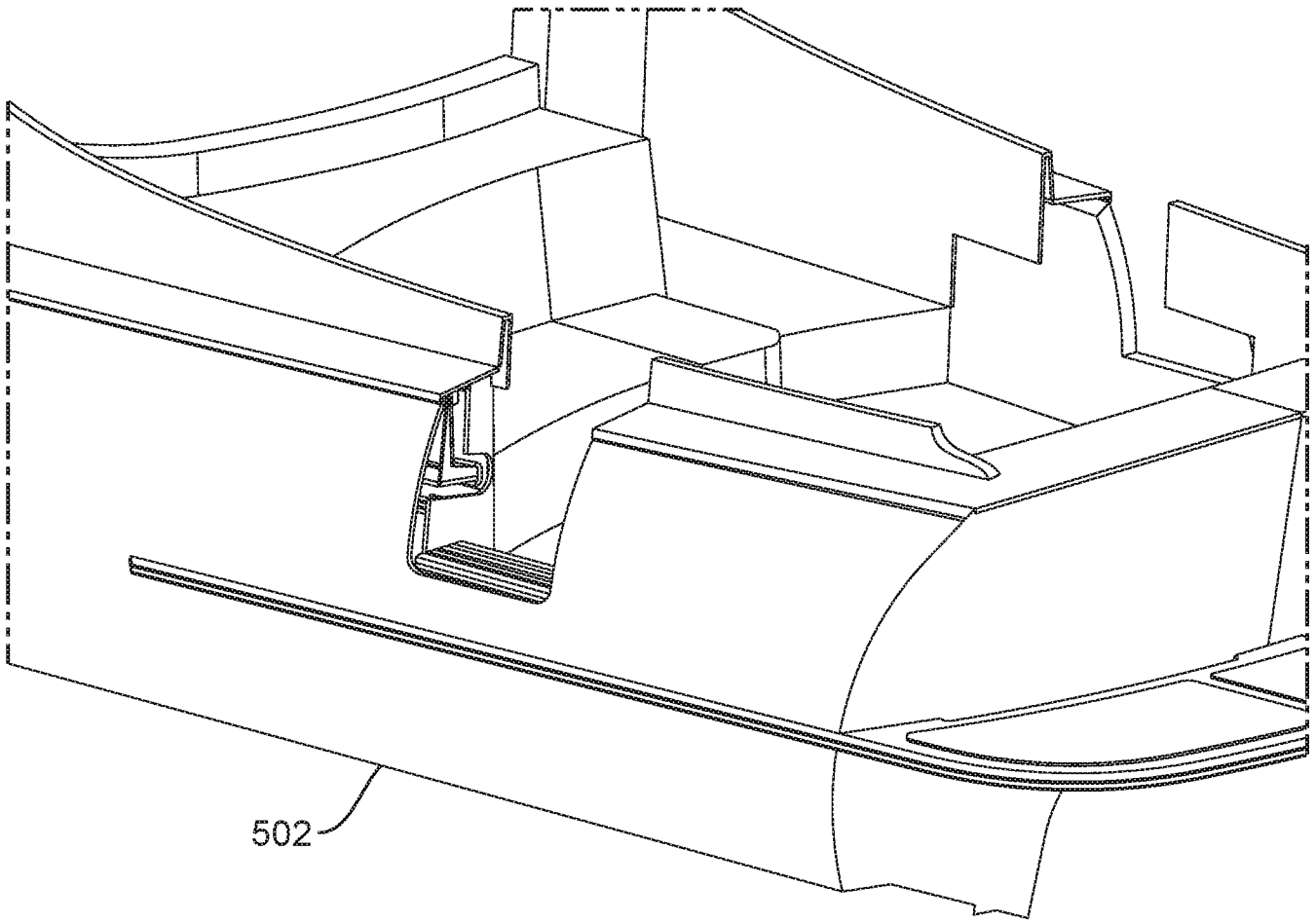
FIG. 14 is an aerial port perspective view from outside the vessel providing a partial cutaway view of the vessels' sidewall/gunwale according to an embodiment of the present invention.

Referring to the Figures, a rotating and sliding boat boarding door assembly 100 is shown in various degrees of articulation (between closed and open) from both inside the boat and outside the boat, according to embodiments of the present invention. As shown, the assembly 100 includes a gunnel or gunwale portion 102 that includes the top-deck portion of the door assembly and a hull or door portion 104, which is the topside hull piece of the door assembly. A recess 108 inside the hull if provided for slidably receiving the gunwale portion 102 and door portion 104 when the door is open, such that the door is hidden in the open position. See, e.g., FIG. 13. When the door is closed, as shown in FIG. 1, the recess may optionally be covered with a retractable or removable recess cover 106.

The recess 108 is shaped to accommodate the gunwale portion 102 and the door portion 104 and, as shown, may be shaped similar to the cross-sectional shape of the gunwale portion 102. Additional space in the recess is also provided toward the exterior to accommodate the door portion 104.

A plurality of actuators are provided to rotate the gunwale portion 102 into position as shown in FIGS. 2-6. According to embodiments of the invention, the gunwale portion 102 and the door portion 104 may be coupled together, for example, by one or more hinges or other mechanisms that will allow the gunwale to rotate. An actuator may also be provided for actuation of the retractable recess cover 106

Figure 6:
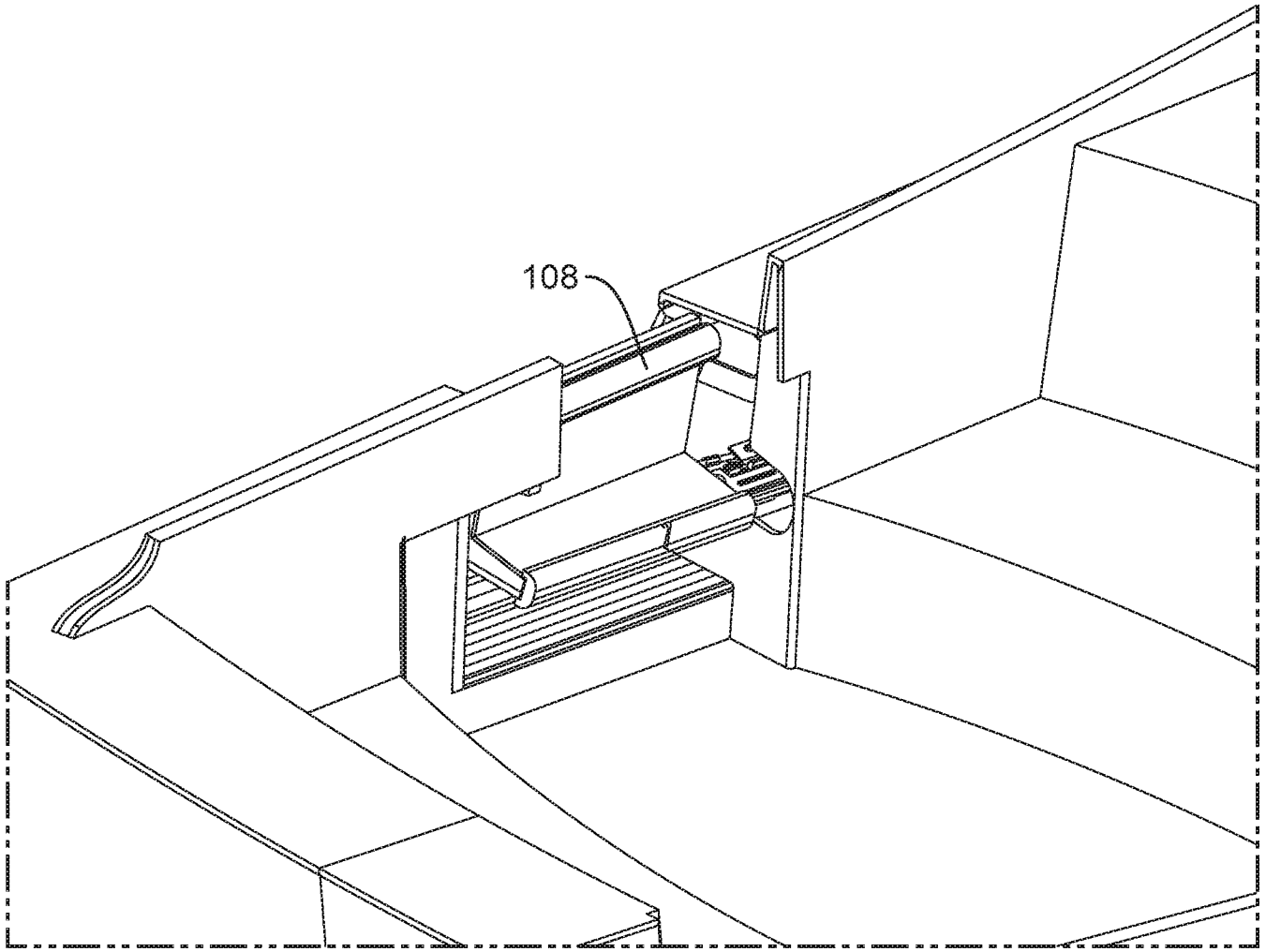
FIG. 6 is an aerial aft perspective view from inside the vessel and a partial cutaway view of the vessels' sidewall/gunwale according to an embodiment of the present invention.
Figure 7:
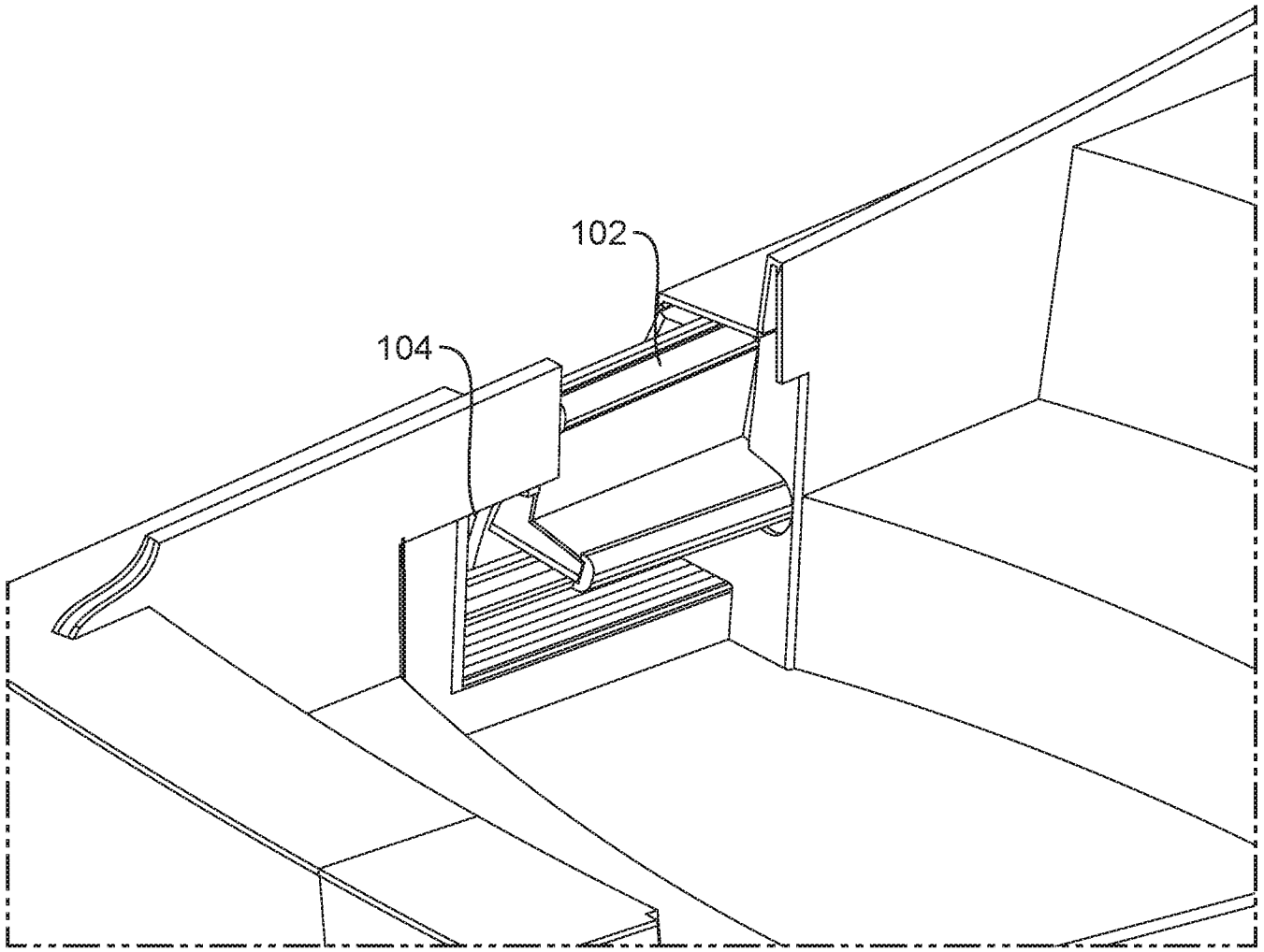
FIG. 7 is an aerial aft perspective view from inside the vessel and a partial cutaway view of the vessels' sidewall/gunwale according to an embodiment of the present invention.
Figure 8:
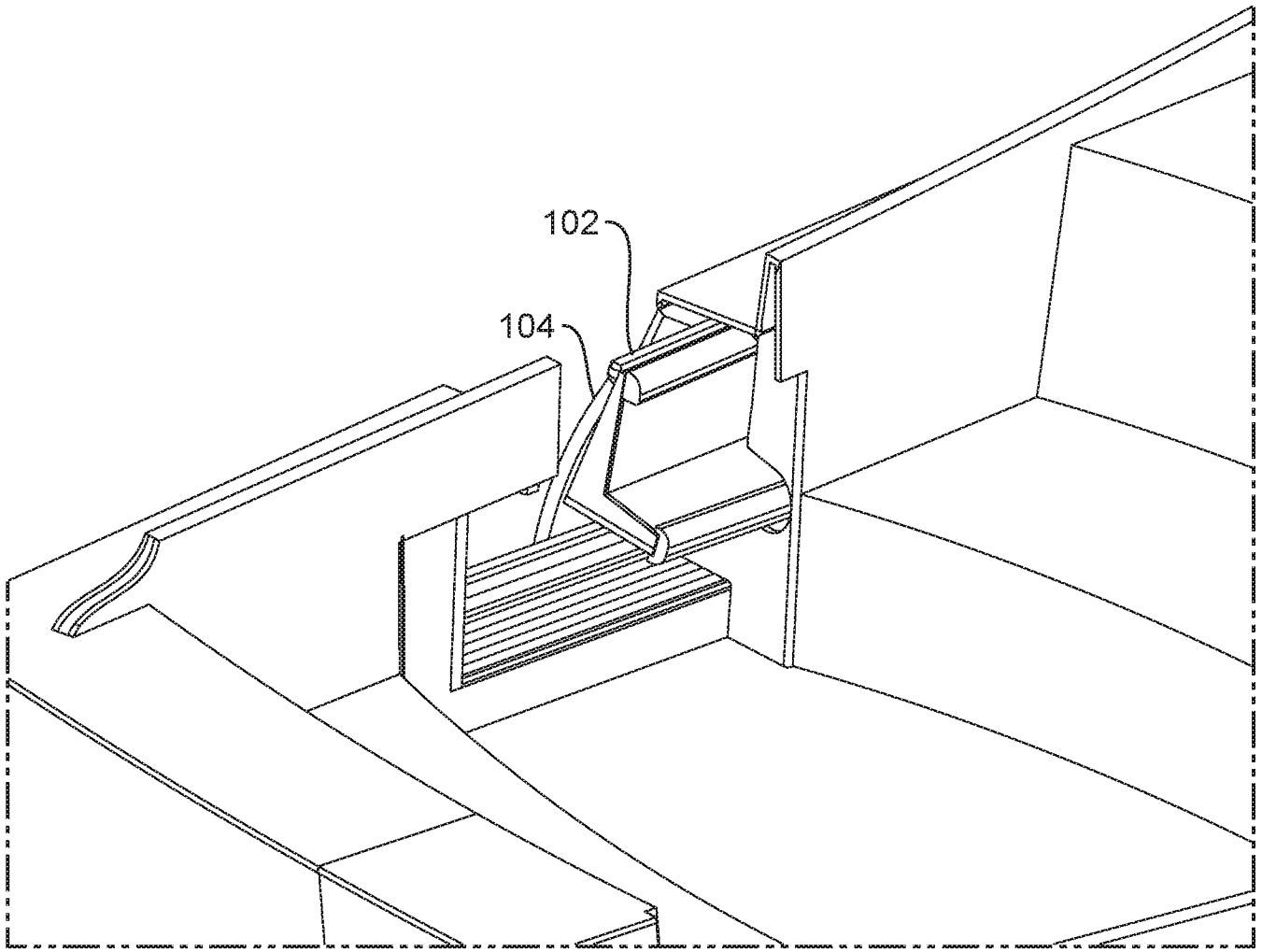
FIG. 8 is an aerial aft perspective view from inside the vessel and a partial cutaway view of the vessels' sidewall/gunwale according to an embodiment of the present invention.
Figure 9:
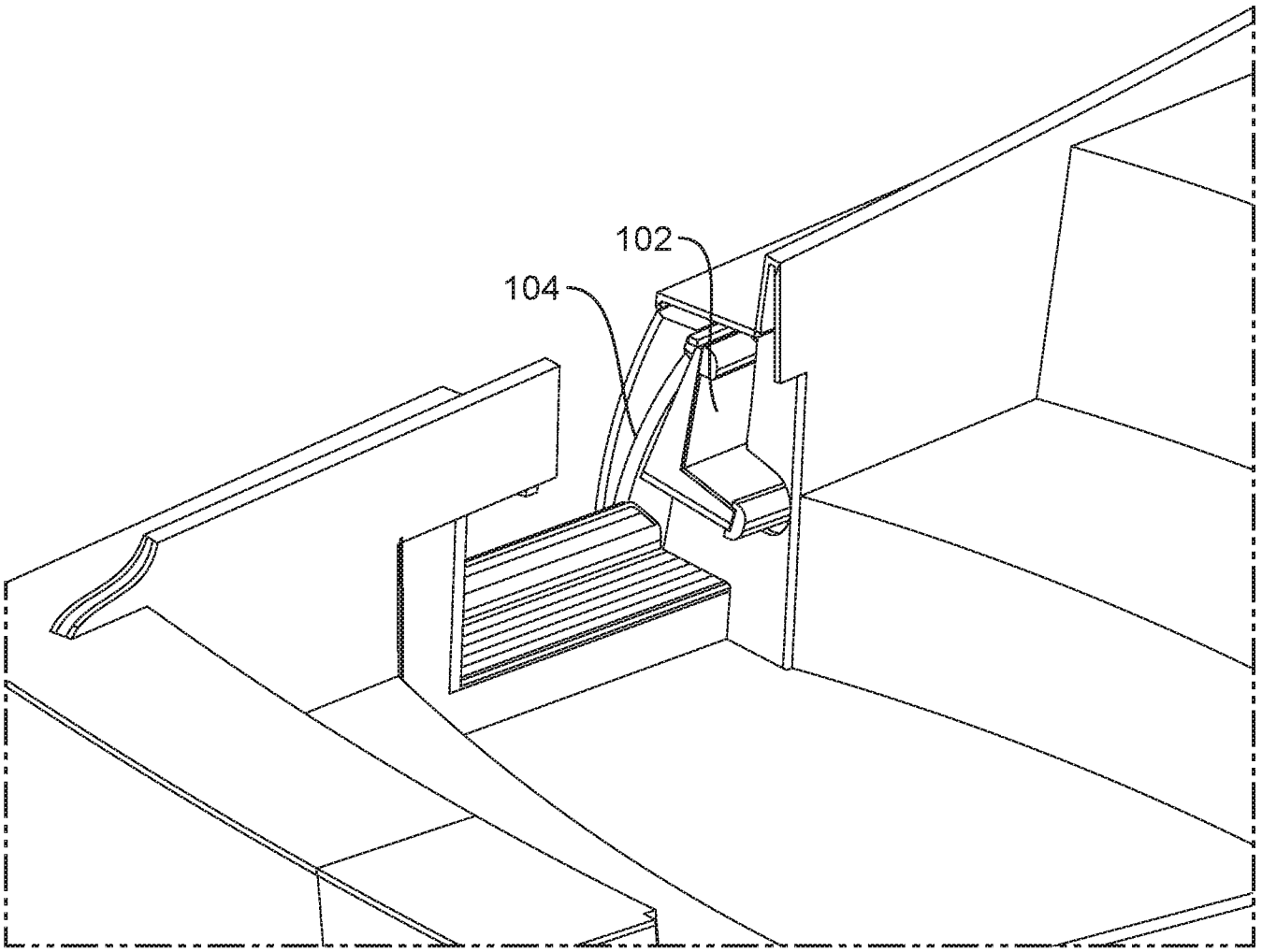
FIG. 9 is an aerial aft perspective view from inside the vessel and a partial cutaway view of the vessels' sidewall/gunwale according to an embodiment of the present invention.
Figure 10:
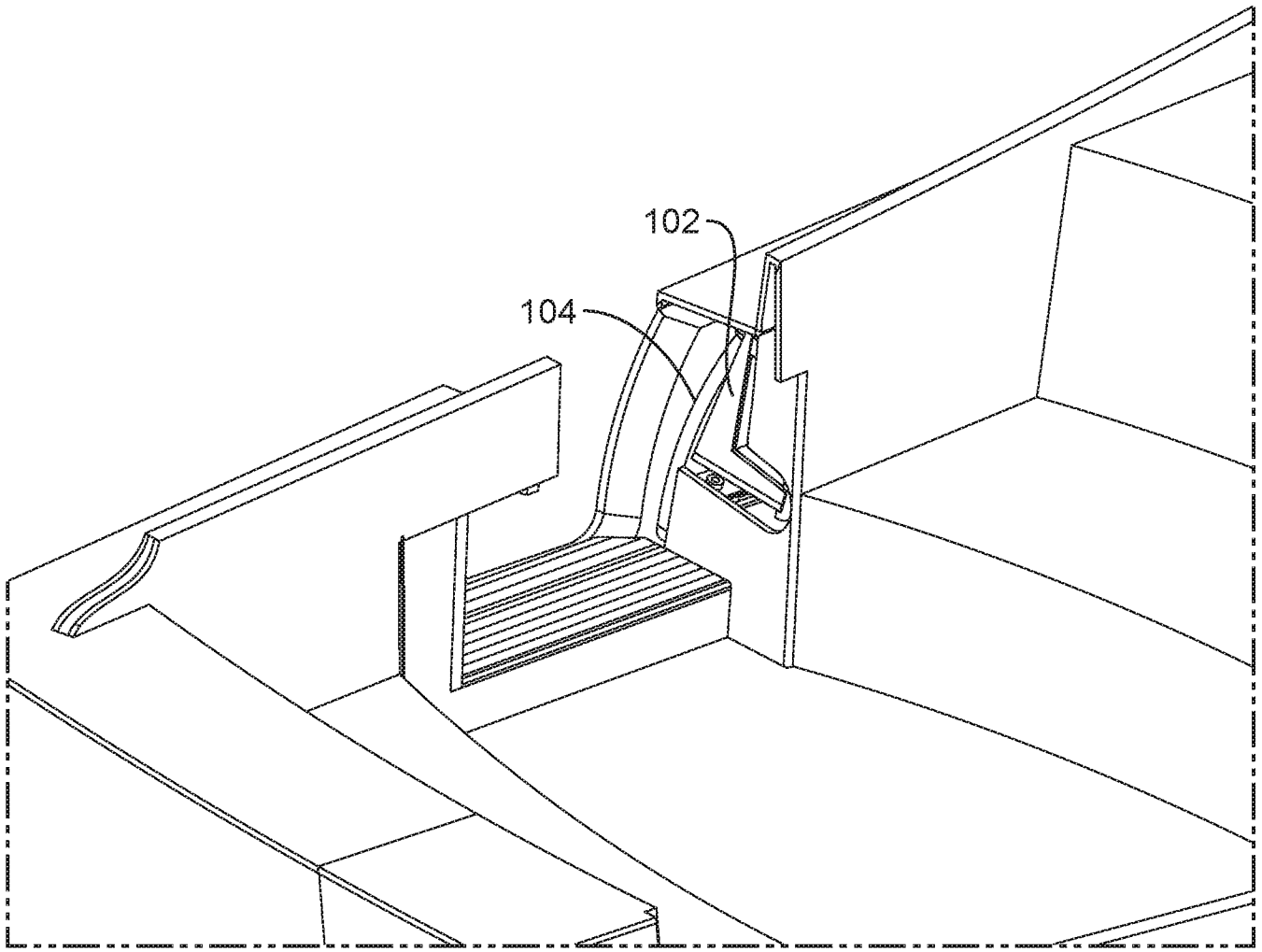
FIG. 10 is an aerial aft perspective view from inside the vessel and a partial cutaway view of the vessels' sidewall/gunwale according to an embodiment of the present invention.

Once the gunwale portion 102 is in position as shown in FIG. 6, the gunwale portion 102 and the door portion 104 may be slide into the recess. Accordingly, actuators are tracks may be provided (see, e.g., FIGS. 11-12) to guide the gunwale portion 102 and the door portion 104 into the recess. It will be understood that the gunwale portion 102 and the door portion 104 can be moved a distance toward the interior prior to or during the sliding motion as shown in FIGS. 7-10.

Figure 11:
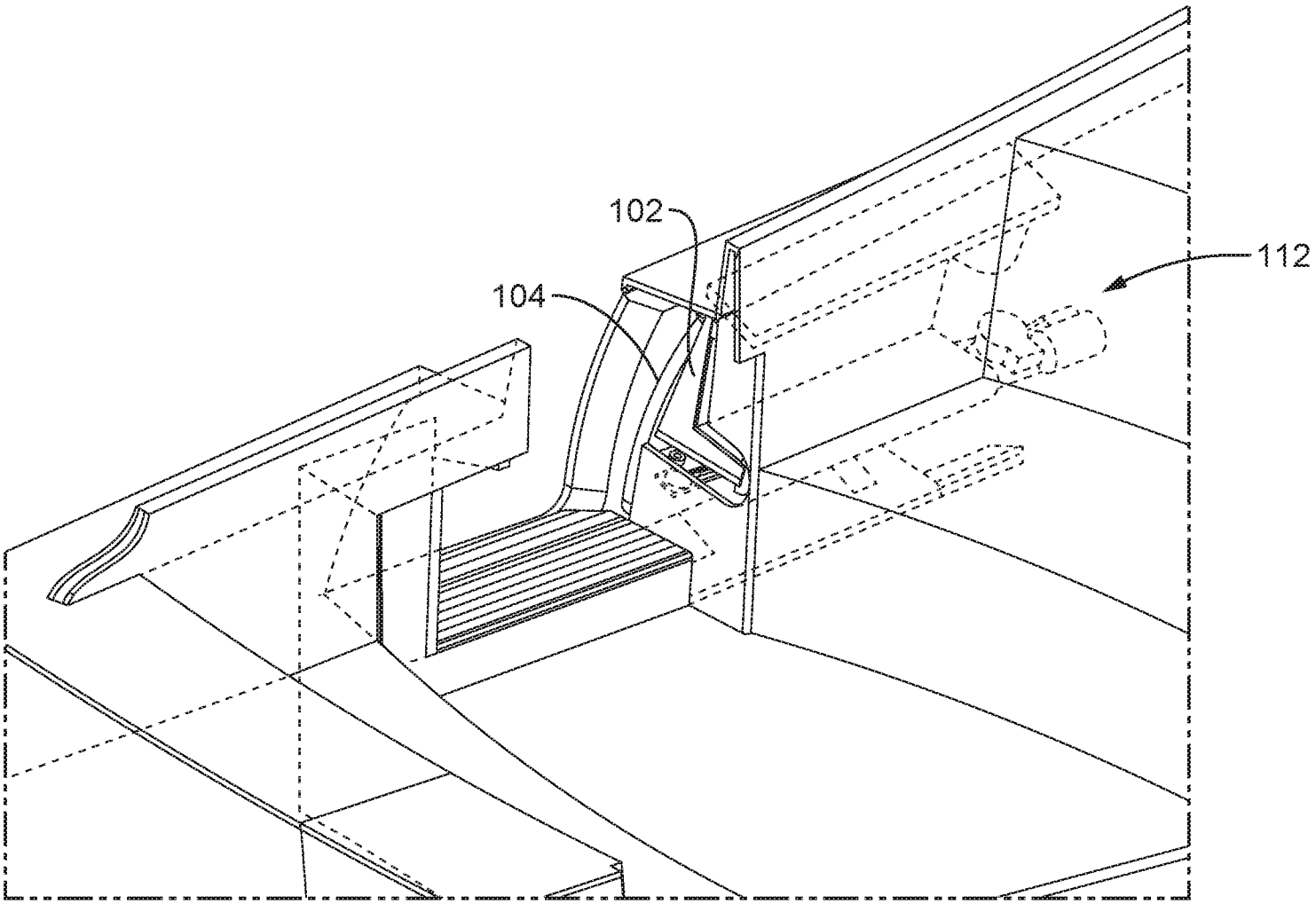
FIG. 11 is an aerial aft perspective view from inside the vessel providing a full cutaway view of the vessels' sidewall/gunwale according to an embodiment of the present invention.
Figure 12:
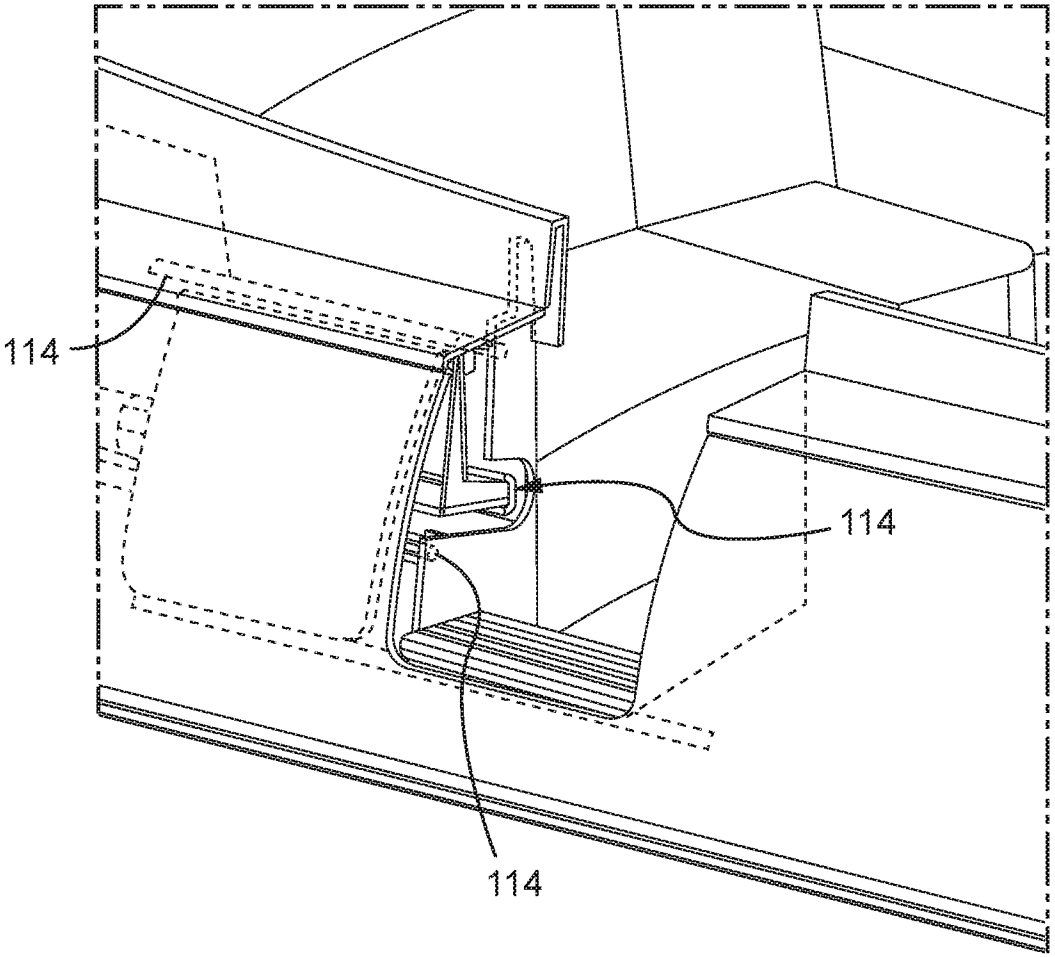
FIG. 12 is an aerial port perspective view from outside the vessel providing a full cutaway view of the vessels' sidewall/gunwale according to an embodiment of the present invention.

FIGS. 11-12 show cutaway perspective views of the assembly 100 from the interior and exterior of the vessel, respectively. As shown, actuators 112 may be provided within the topside of the vessel to slide the gunwale portion 102 and the door portion 104 into and out of the recess. Tracks 114 can be coupled to the gunwale portion 102 and the door portion 104 at various points to guide them into and out of the recess properly. According to one embodiment, a track 114 may be provided at the top end of the assembly where gunwale portion 102 and the door portion 104 are hinged, another may be provided at the bottom of the door portion 104, and a third may be provided in the middle of the assembly coupled with the door portion 104 and/or the bottom of the gunwale portion 102.

The actuators may be manually operated, mechanical, hydraulic, or electric, or a combination thereof. According to a preferred embodiment of the invention, articulation of the door assembly 100 is completely automated. Accordingly, wireless controls (not shown) may be provided, as well as a local switch or helm switch, to control the actuators. Preferably, DC linear actuators are used where possible.

Figure 27:
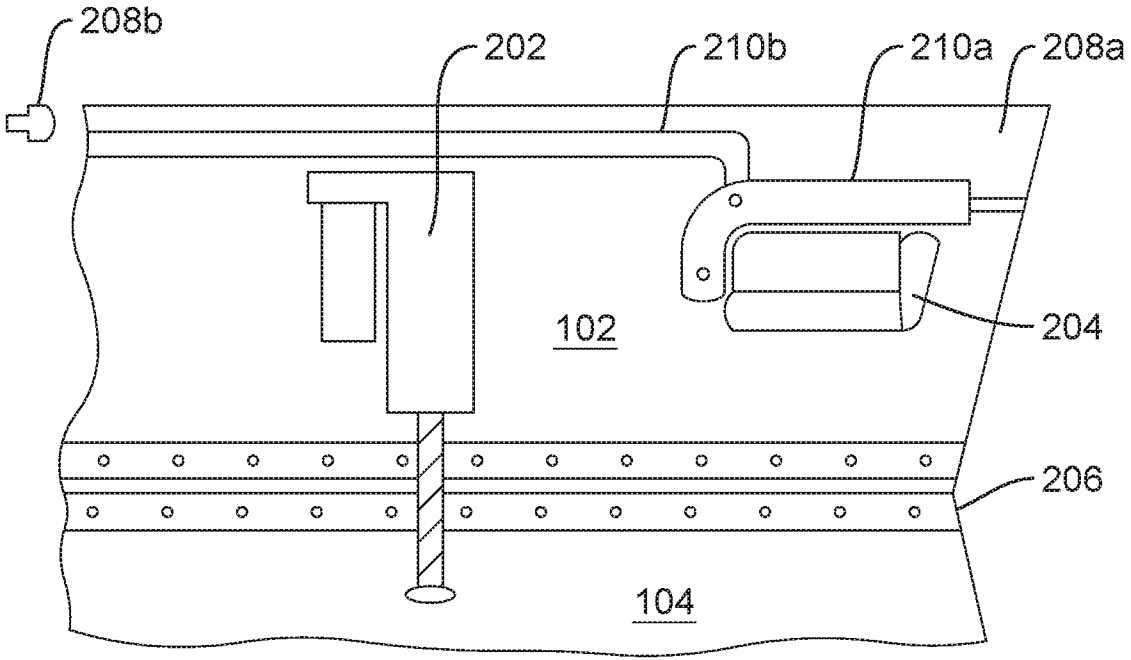
FIG. 27 is a view of the bottom side of the gunnel portion of the door assembly according to an embodiment of the present invention.

FIG. 27 shows a partial view of the coupling between the gunwale portion 102 and the door portion 104 according to an embodiment of the present invention. The gunwale portion 102 and the door portion 104 can be coupled by a hinge, preferably a stainless steel piano hinge 206. On the bottom side of the gunnel, a linear actuator 202 can be mounted with the distal end of its arm coupled to the door portion 104. The linear actuator 202 can be positioned and configured such that when the arm is full extended, the gunwale portion 102 is in its normal position. By retracting the arm, the gunwale portion 102 is rotated into the sliding position.

A second actuator 204 may be provided for locking the gunwale portion 102 into place in its normal position. According to one embodiment, the actuator is coupled to linkages 210*a* and 210*b* locking pins so that the actuator 204 can extend locking pins 208*a* and 208*b* into corresponding recesses (not shown) in the hull, to secure the door in the closed position. Of course, the door can be secured by other, preferably automate means. For example, latches or other securing mechanisms could be used.

Figure 28:
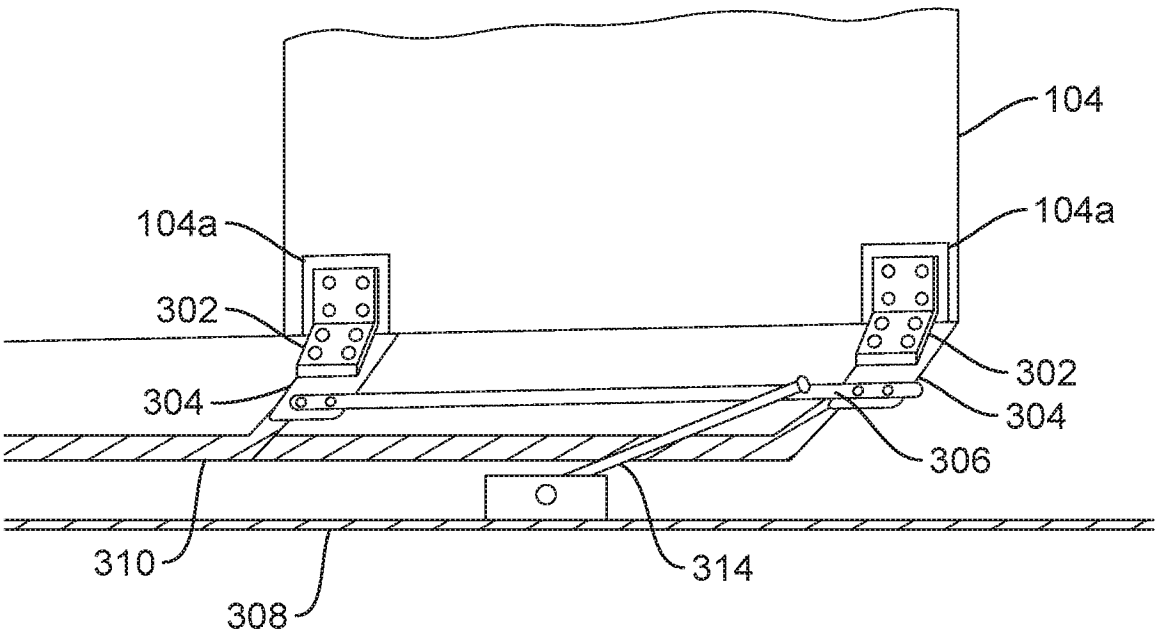
FIG. 28 is a view of the bottom, inside portion of the door portion of the door assembly according to an embodiment of the present invention.

FIG. 28 shows a partial view of bottom of the door portion 104 coupled to a track according to an embodiment of the present invention. As shown, feet 302 may be coupled to the door portion 104 at pads 104*a*. Feet 302 may include extensions 304 which couple to a preferably stainless steel linkage 306, which includes following pins beneath it seating into a groove 310. Actuator 314 is connected to the linkage 306 on one end and to a conveyor 308 on the other, such that actuator 314 may pull the door portion 104 inward a sufficient distance so that it may then slide into the recess 106 in the hull. Conveyor 314 may be, for example, a belt driven by an actuator (not shown). Other means for moving the door portion 104 in the sliding direction may be used, such as, cables or linear motors. Groove 310 may include an angled portion to facilitate positioned of the door into a sliding position before the door portion 104 is slid parallel to the length of the boat into the recess. The groove 310 can be formed with appropriate materials, such as fiber reinforced plastics or the like. A commercial embodiment of the invention utilizes DELRIN for this track. The groove 310 can be lubricated for provided with bearings for reliable and efficient performance.

Figure 29:
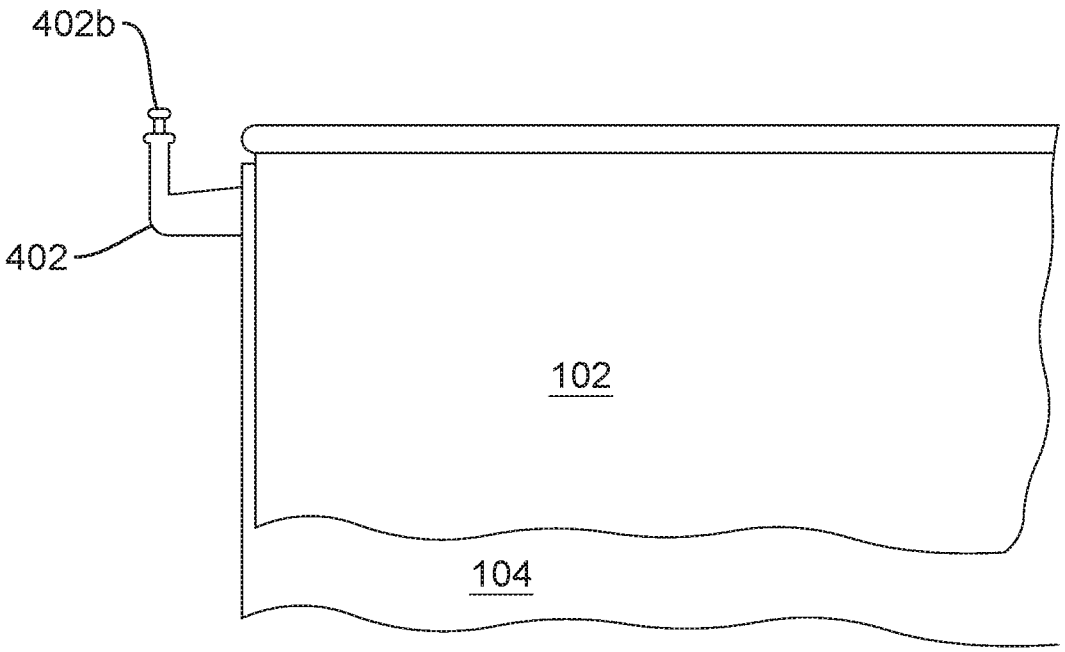
FIG. 29 is a view of the top, inside portion of the door portion and gunwale portion of the door assembly, in the sliding position, according to an embodiment of the present invention.

FIG. 29 shows a partial view of the top of the door portion 104 with the gunwale portion 102 in the sliding position (i.e., rotated down). A track arm 402 maybe be coupled to the side of the door portion 104 facing the recess 106. The arm 402 preferably includes a following pin 402*b* which may be secured to a track 114 inside of the recess 106 (see FIG. 12), for more stable sliding of the door.

Figure 2:
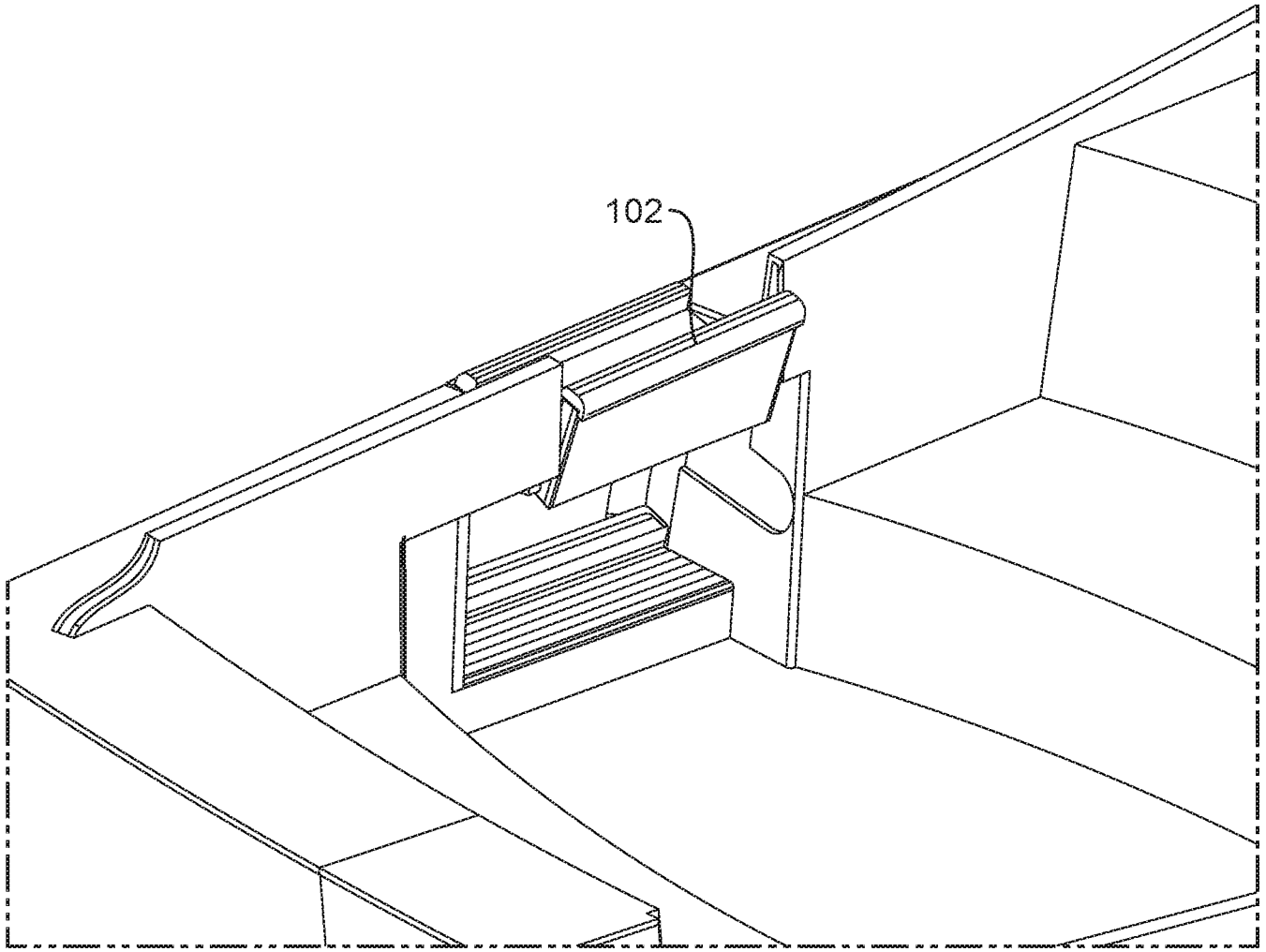
FIG. 2 is an aerial aft perspective view from inside the vessel according to an embodiment of the present invention.
Figure 3:
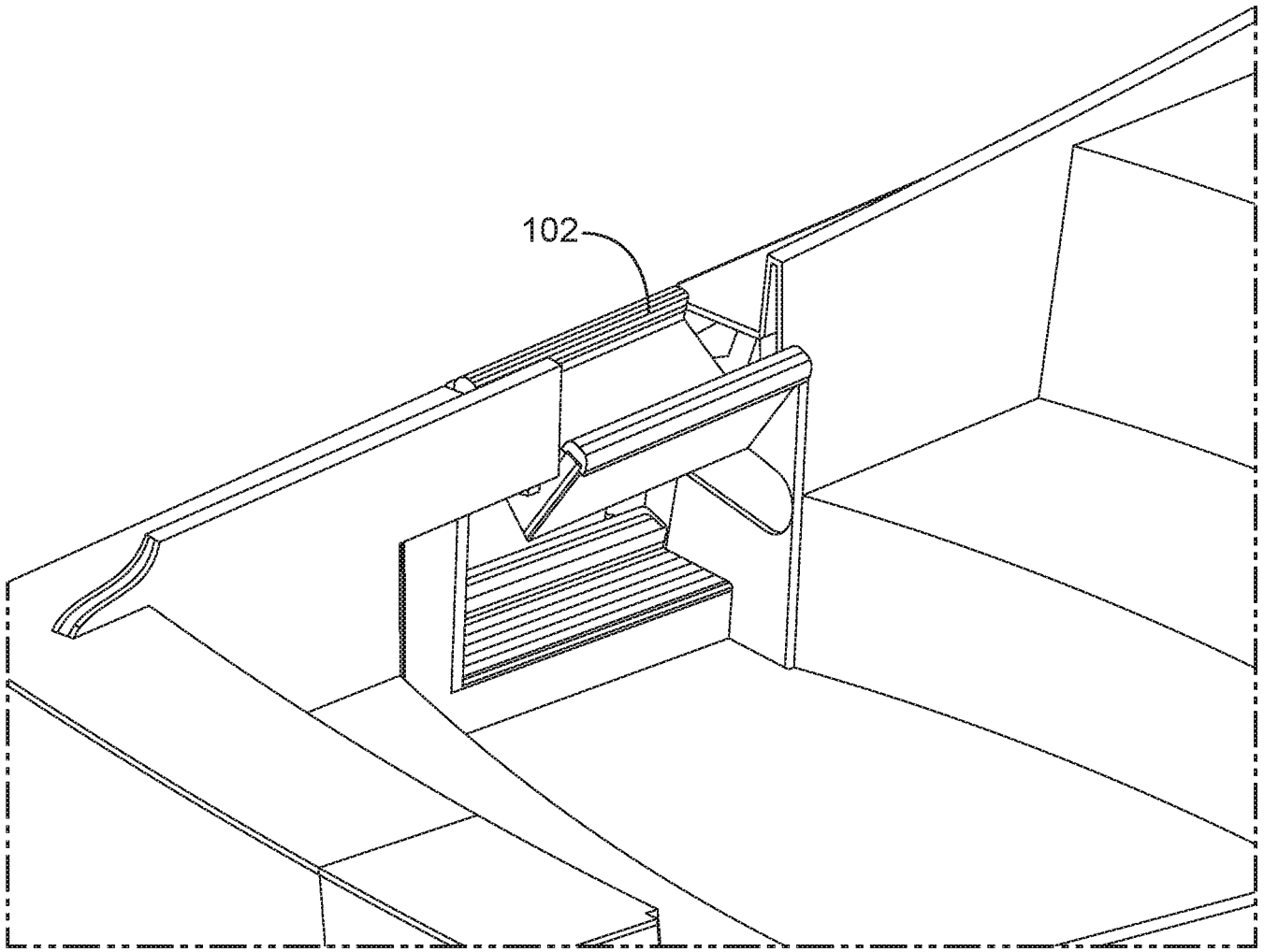
FIG. 3 is an aerial aft perspective view from inside the vessel according to an embodiment of the present invention.
Figure 4:
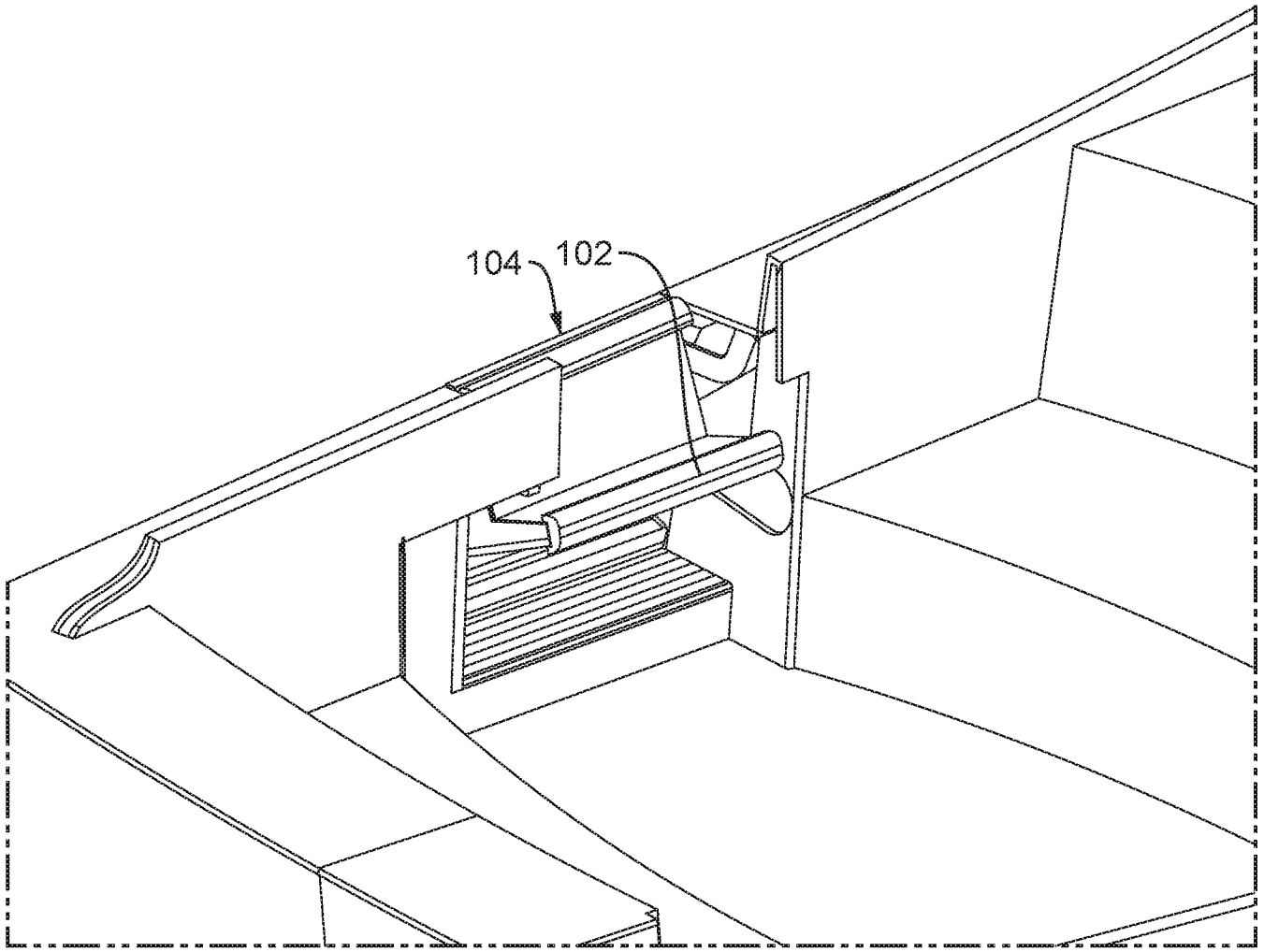
FIG. 4 is an aerial aft perspective view from inside the vessel according to an embodiment of the present invention.
Figure 5:
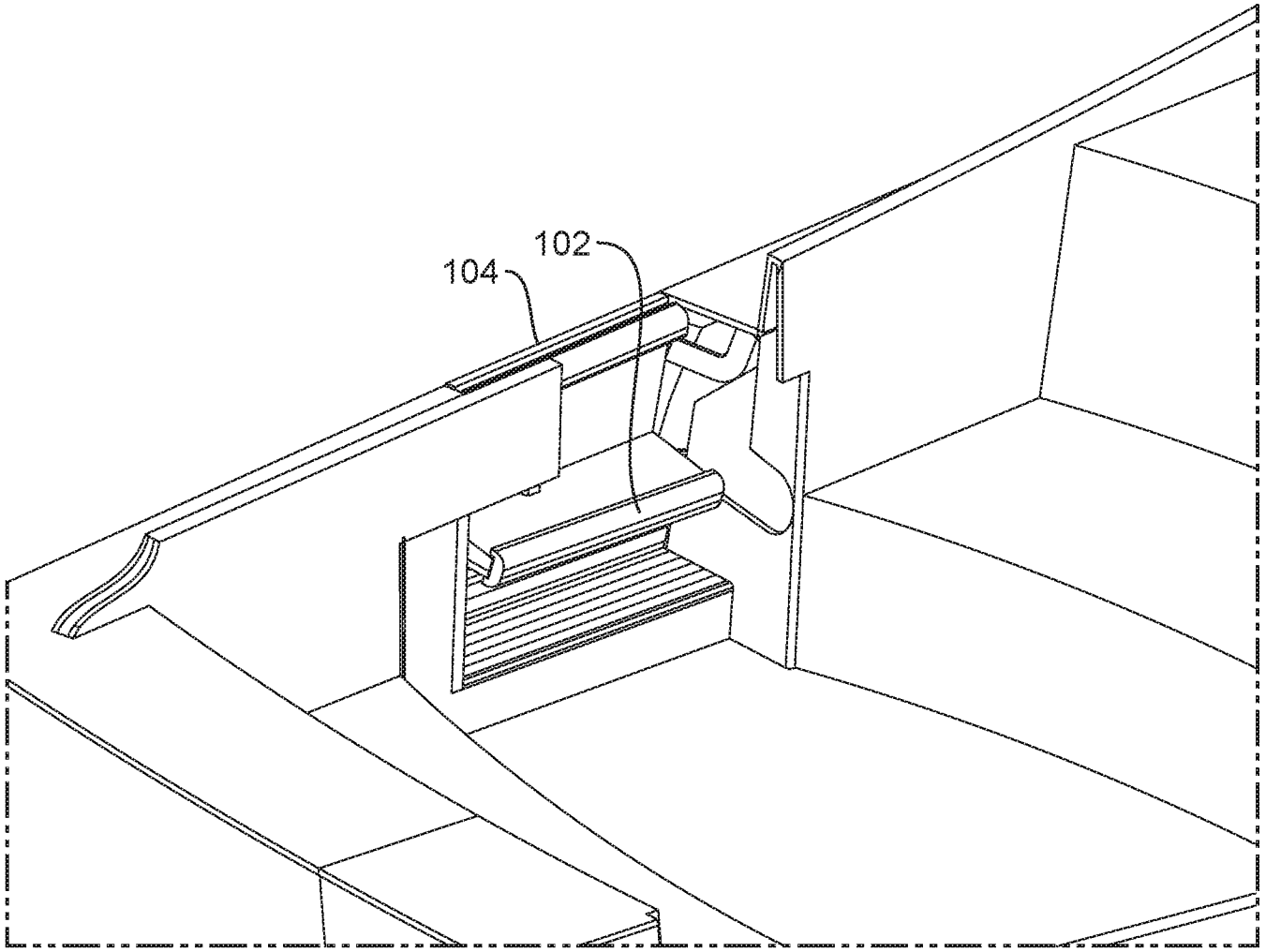
FIG. 5 is an aerial aft perspective view from inside the vessel according to an embodiment of the present invention.

Operation of the door assembly can be readily understood by stepping through FIGS. 1-10. As shown in FIG. 1, the door is in the closed position and preferably latched or otherwise secured. FIG. 2 illustrates the beginning of the step of rotating the gunwale portion 102 to the sliding position. As described herein, with the use of a linear actuator or other means, the gunwale portion 102 may be rotated about a hinge or other rotational coupling. As shown in FIG. 3, the gunwale portion 102 is about 50% rotated. In FIG. 4, the gunwale is nearly rotated and the top of the door portion 104, previously below the toe rail, is now exposed. In FIG. 5, the gunwale portion 102 is fully rotated into the sliding position.

Comparing FIG. 5 to FIG. 6, one can see the door portion 104 and gunwale portion 102 are moved toward the interior of the vessel so as to be aligned with the recess 106, which is now exposed (optional cover removed). As described herein, an actuator may be used to pull the door inward, preferably with the assistance of a track. FIG. 11 shows an actuator 112 for sliding the door portion 104 and gunwale portion 102 into and out of the recess 106.

FIGS. 7-10 illustrate the door portion 104 and gunwale portion 102 being slid into the recess, such as by a cable driven actuator or the like. Optional recess cover could be positioned to cover the recess.

Figure 26:
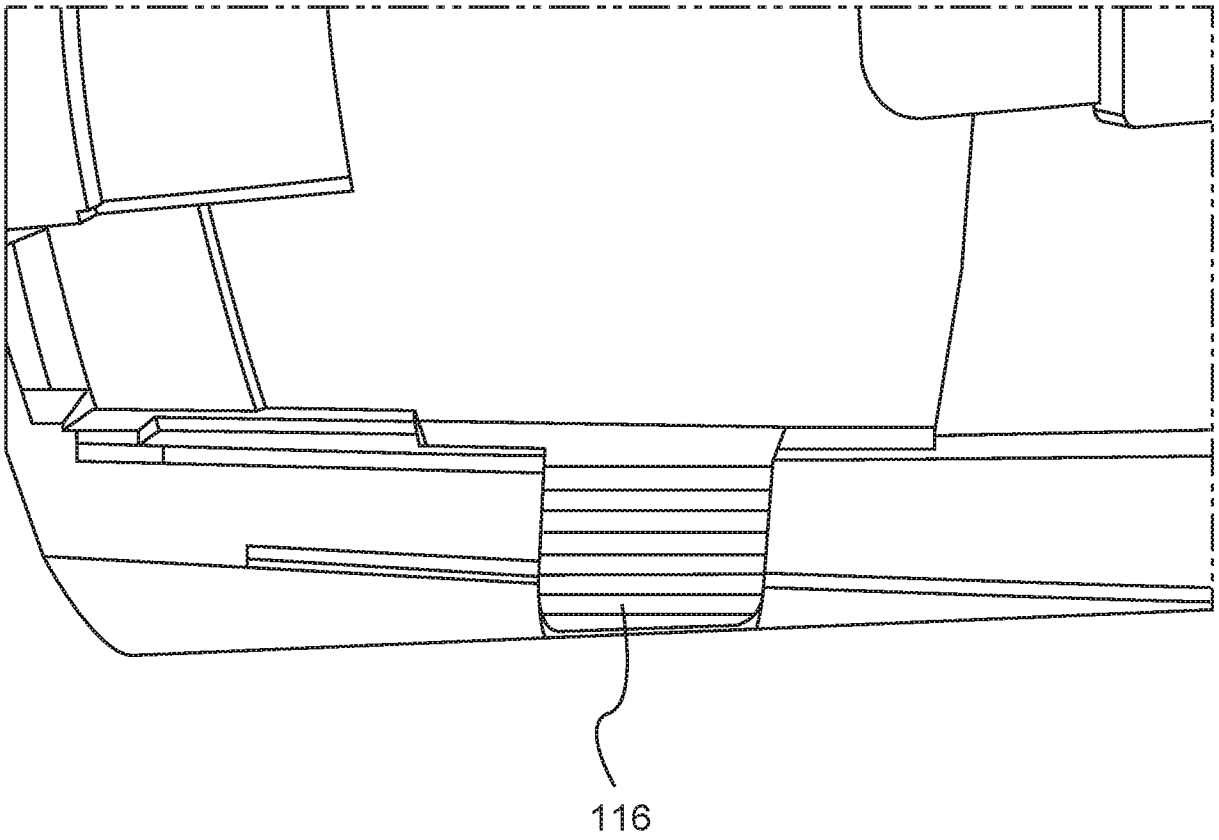
FIG. 26 is an overhead perspective view from outside the vessel according to an embodiment of the present invention.

A step 116 may be provided for safe entry to or exist from the vessel. According to an embodiment of the present invention, the step 116 may be two part, coupled with a hinge (not shown). When the door is in the closed position, step part 116*b* is positioned up at an angle against the door portion. When the door is slide open, the step part 116*b* will move downward (e.g., by gravity) to cover the exposed portion of the hull, below the opening in the hull formed be removal of the door portion 104. Compare FIGS. 9 and 10. See also, FIG. 26, which is an overhead view of the open door showing step 116 covers the entire floor of the opening.

Figure 15:
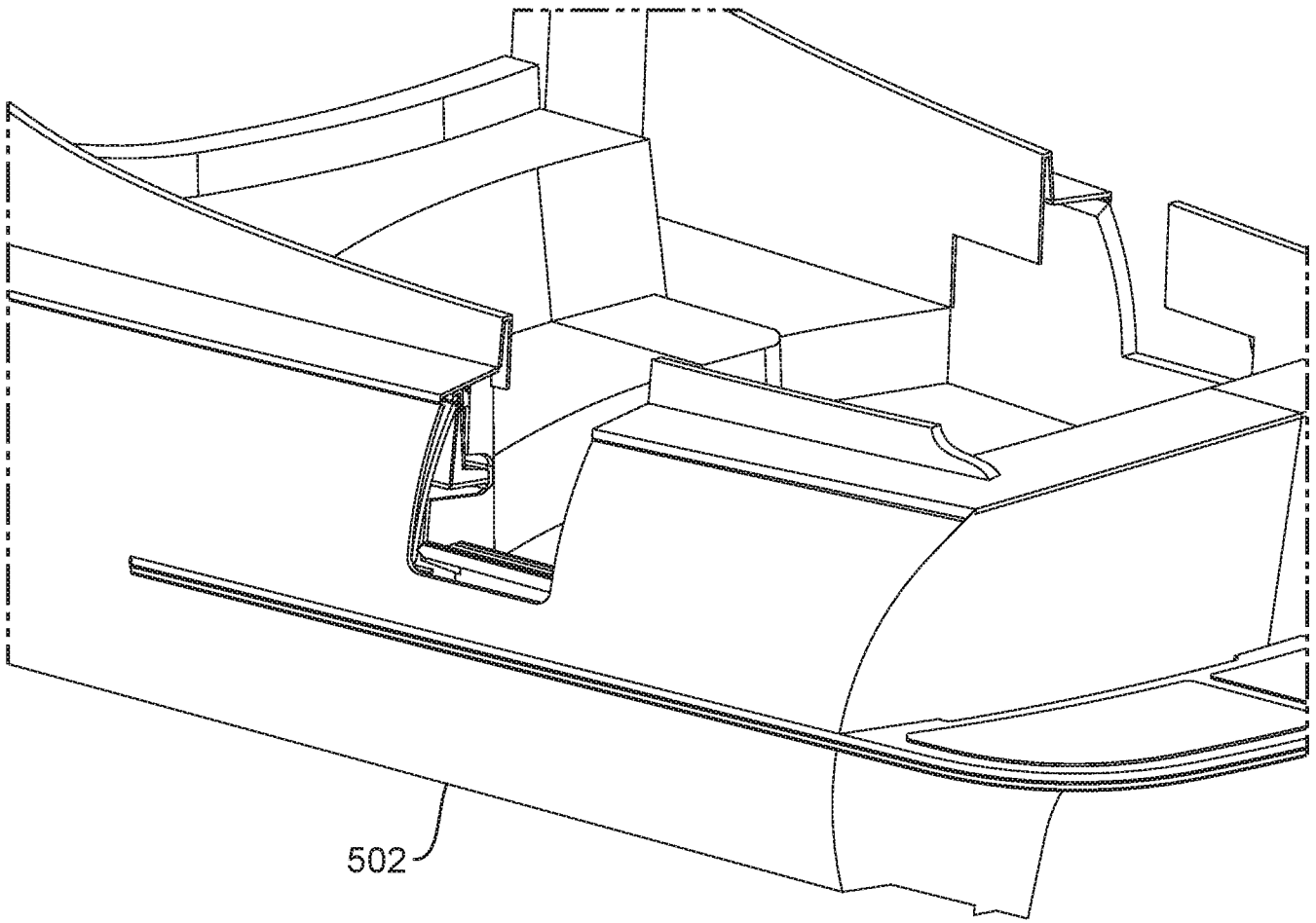
FIG. 15 is an aerial port perspective view from outside the vessel providing a partial cutaway view of the vessels' sidewall/gunwale according to an embodiment of the present invention.
Figure 16:
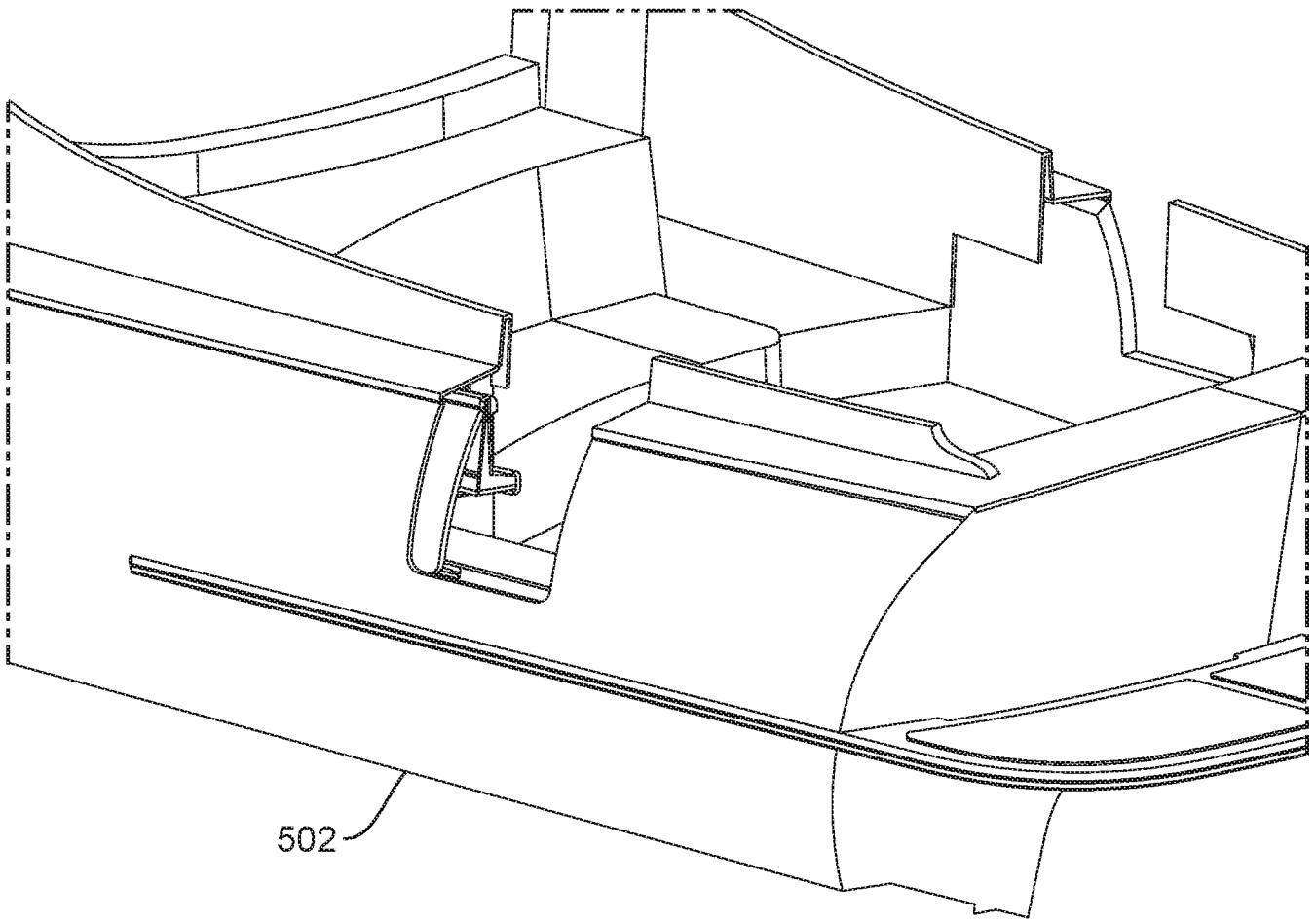
FIG. 16 is an aerial port perspective view from outside the vessel according to an embodiment of the present invention.
Figure 17:
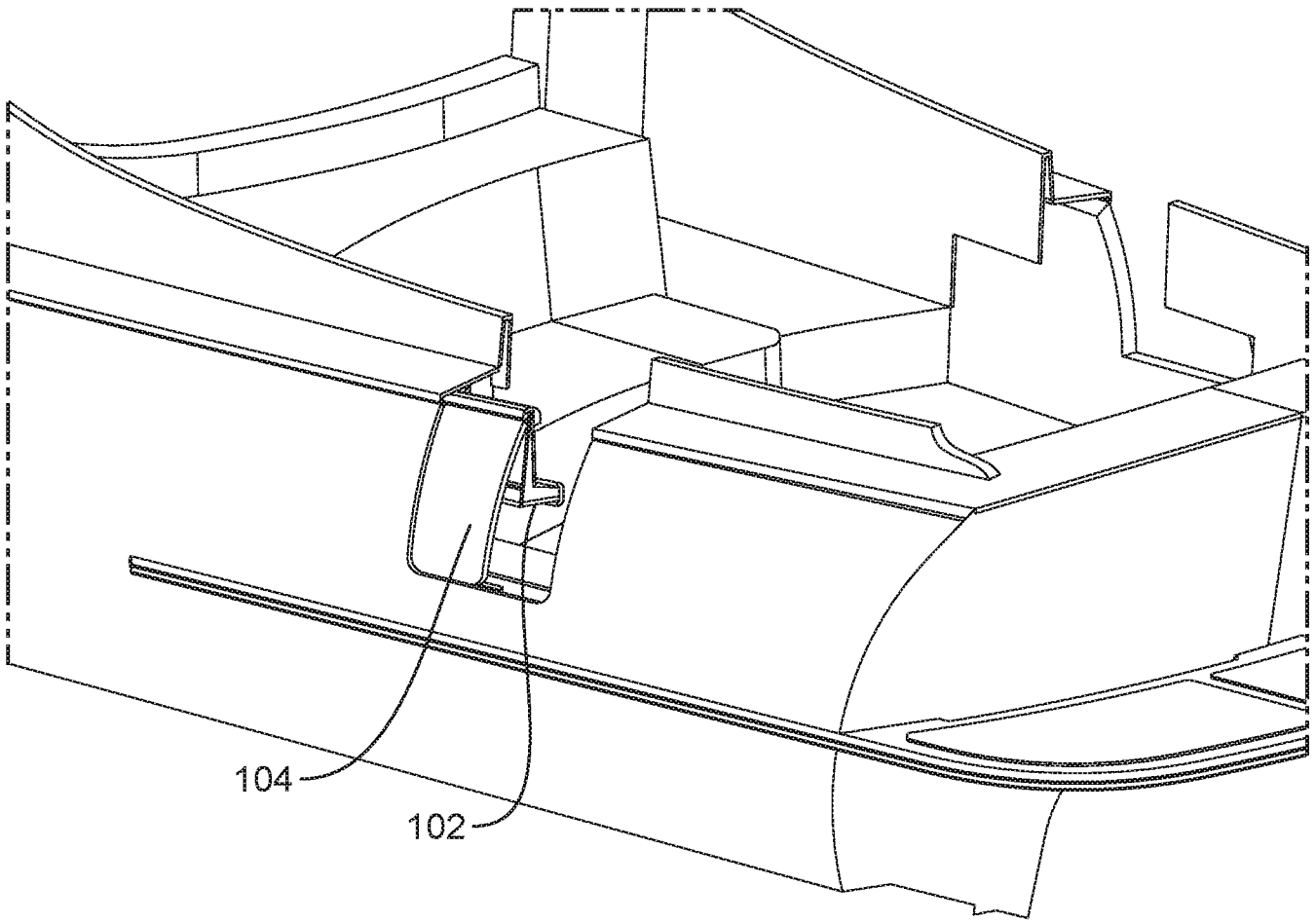
FIG. 17 is an aerial port perspective view from outside the vessel according to an embodiment of the present invention.
Figure 18:
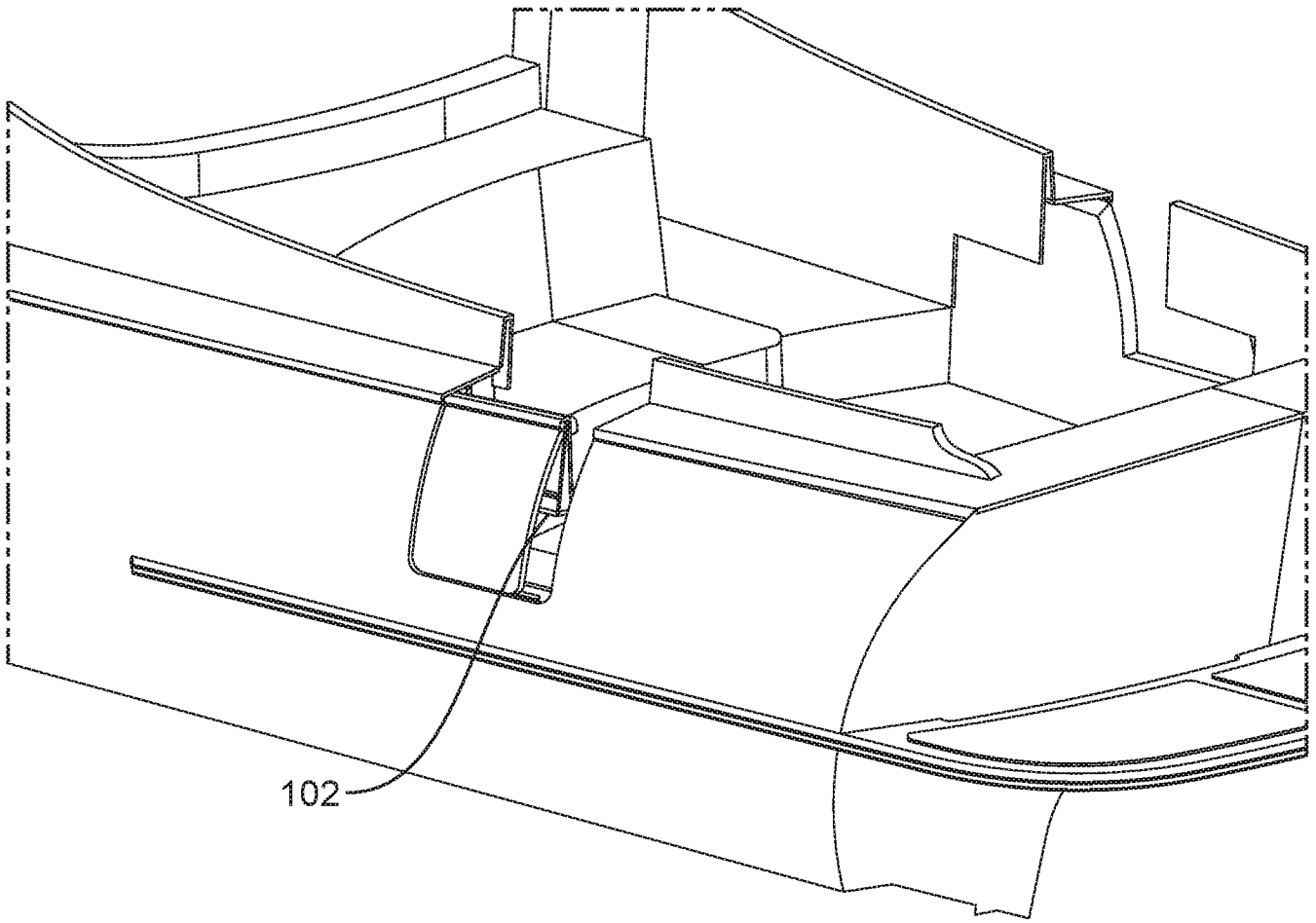
FIG. 18 is an aerial port perspective view from outside the vessel according to an embodiment of the present invention.
Figure 19:
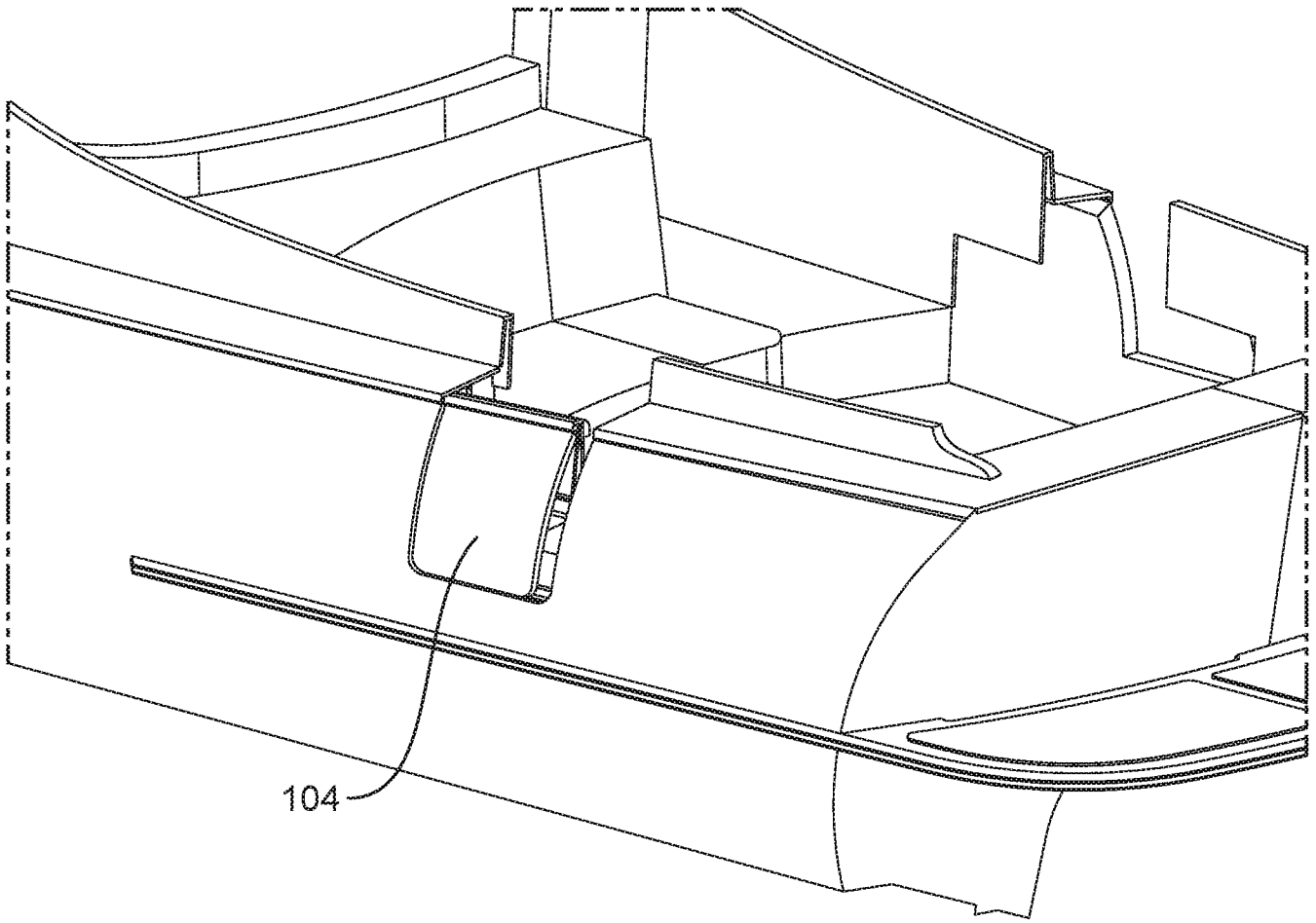
FIG. 19 is an aerial port perspective view from outside the vessel according to an embodiment of the present invention.
Figure 20:
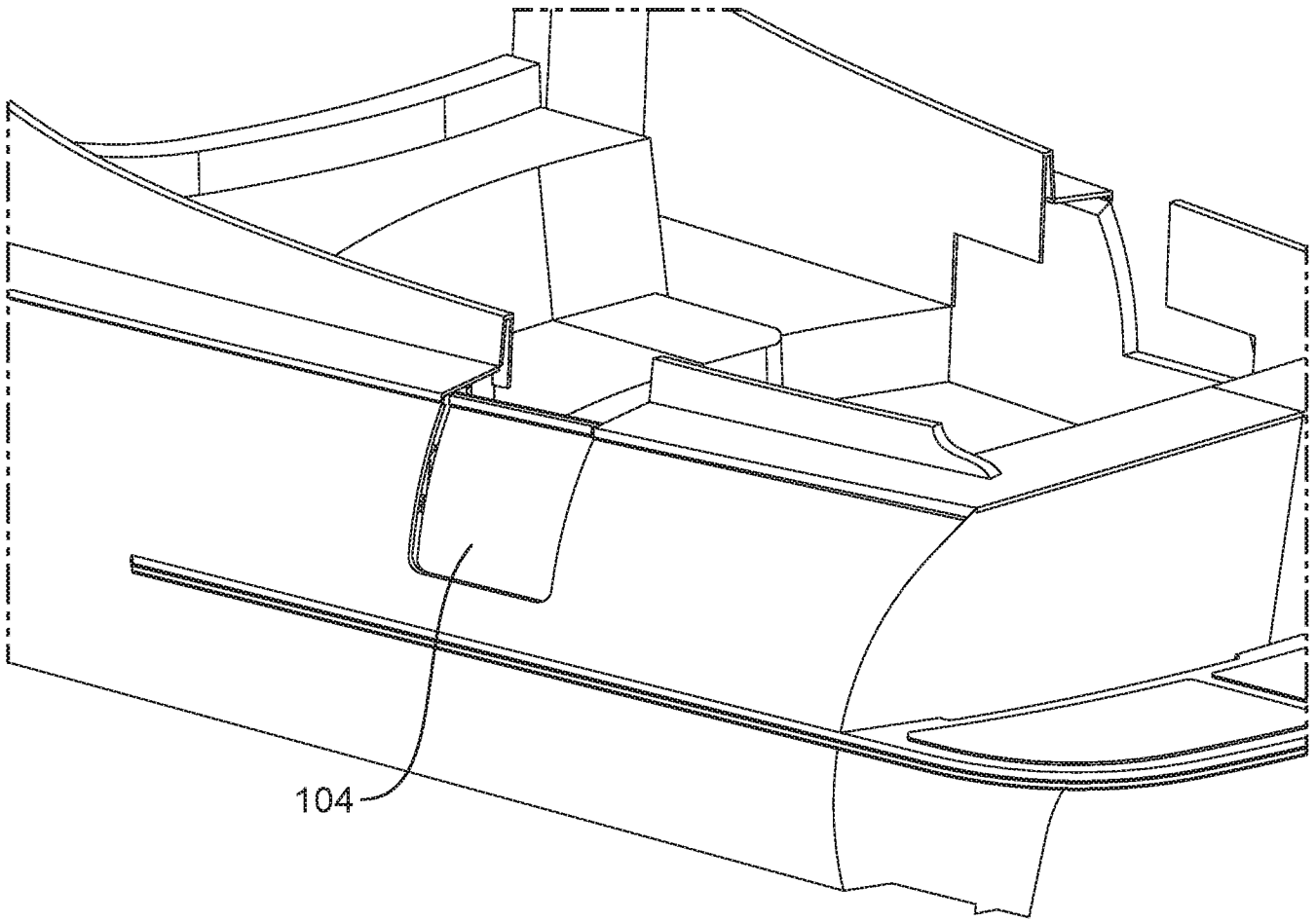
FIG. 20 is an aerial port perspective view from outside the vessel according to an embodiment of the present invention.
Figure 21:
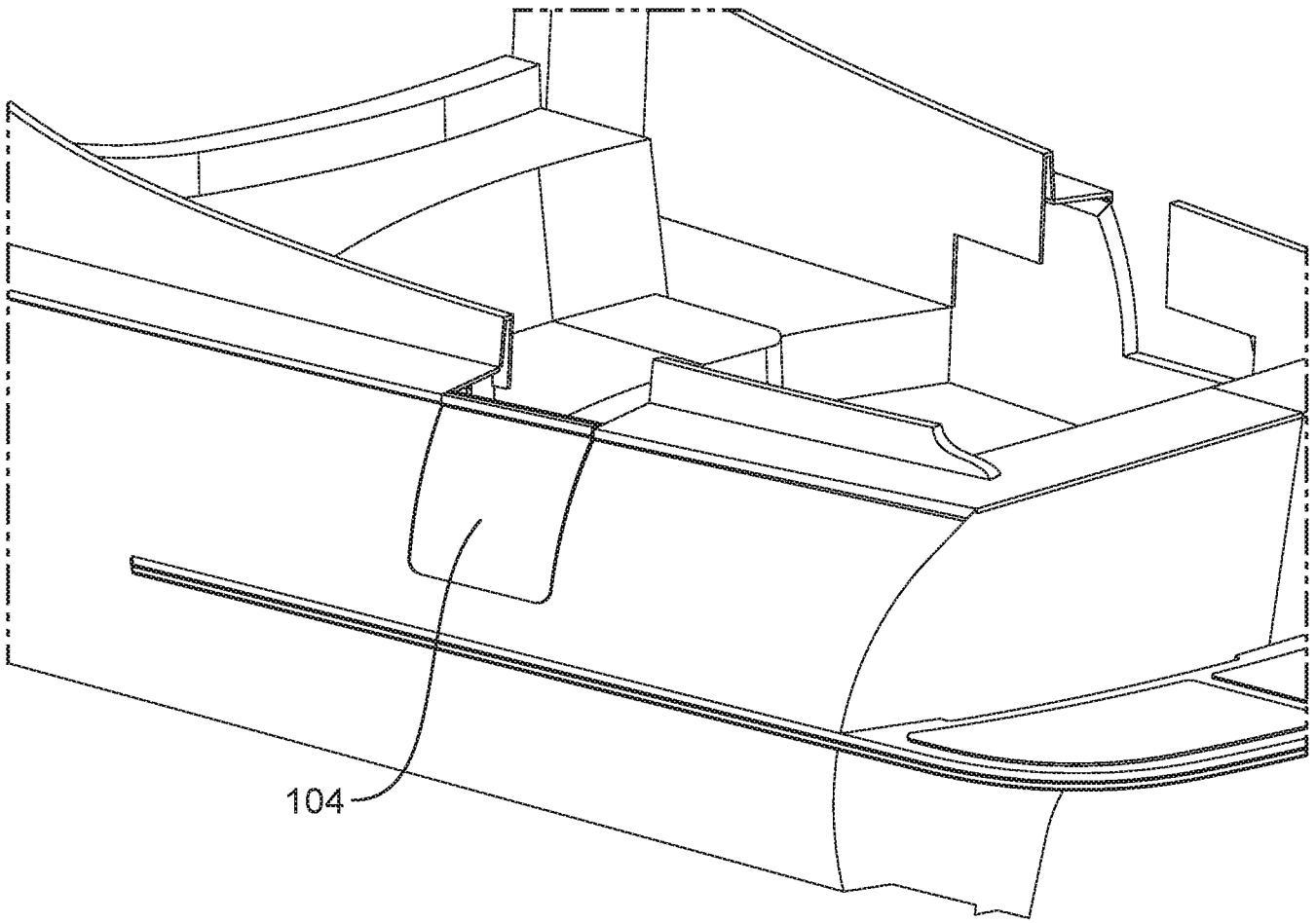
FIG. 21 is an aerial port perspective view from outside the vessel according to an embodiment of the present invention.
Figure 22:
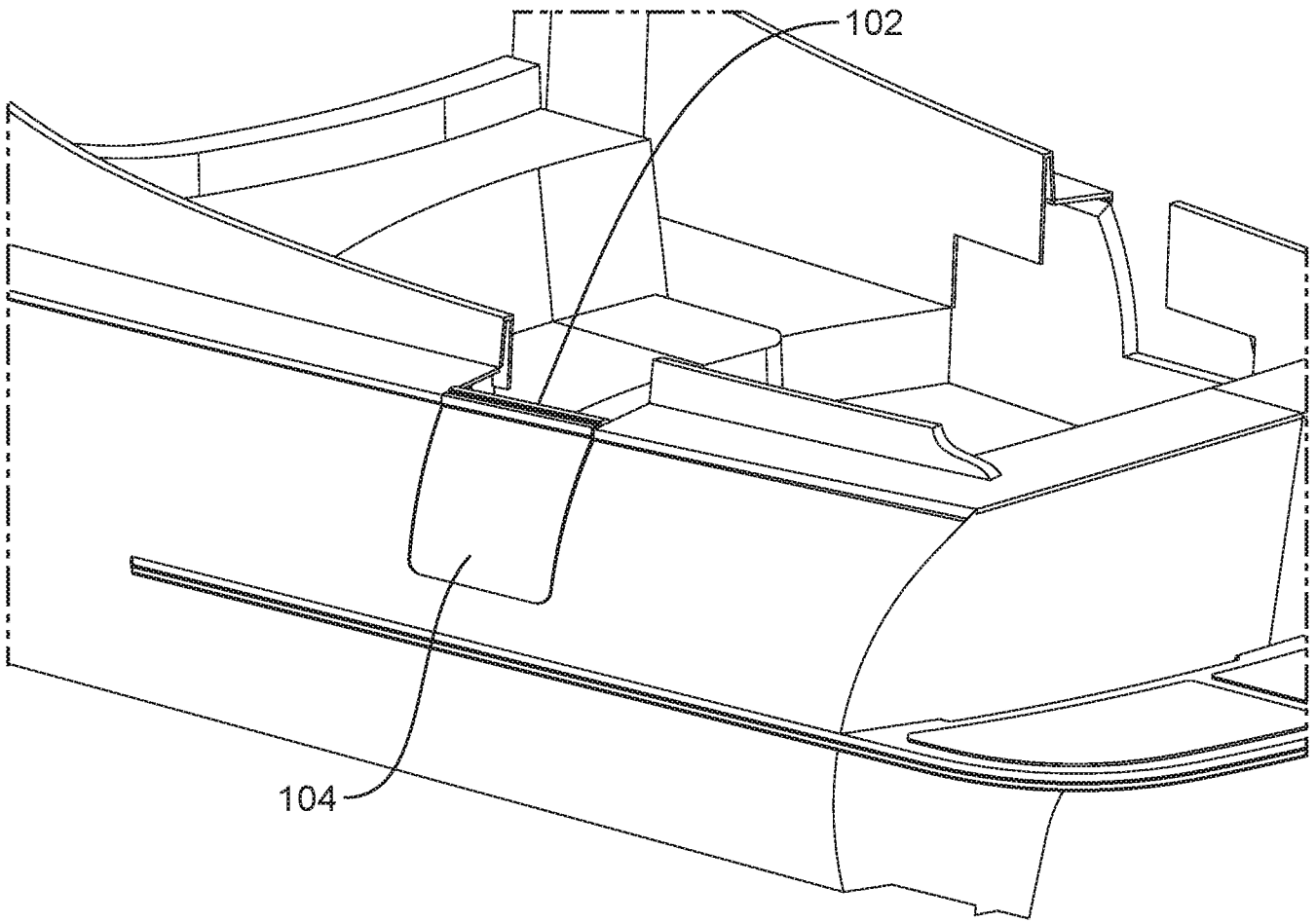
FIG. 22 is an aerial port perspective view from outside the vessel according to an embodiment of the present invention.
Figure 23:
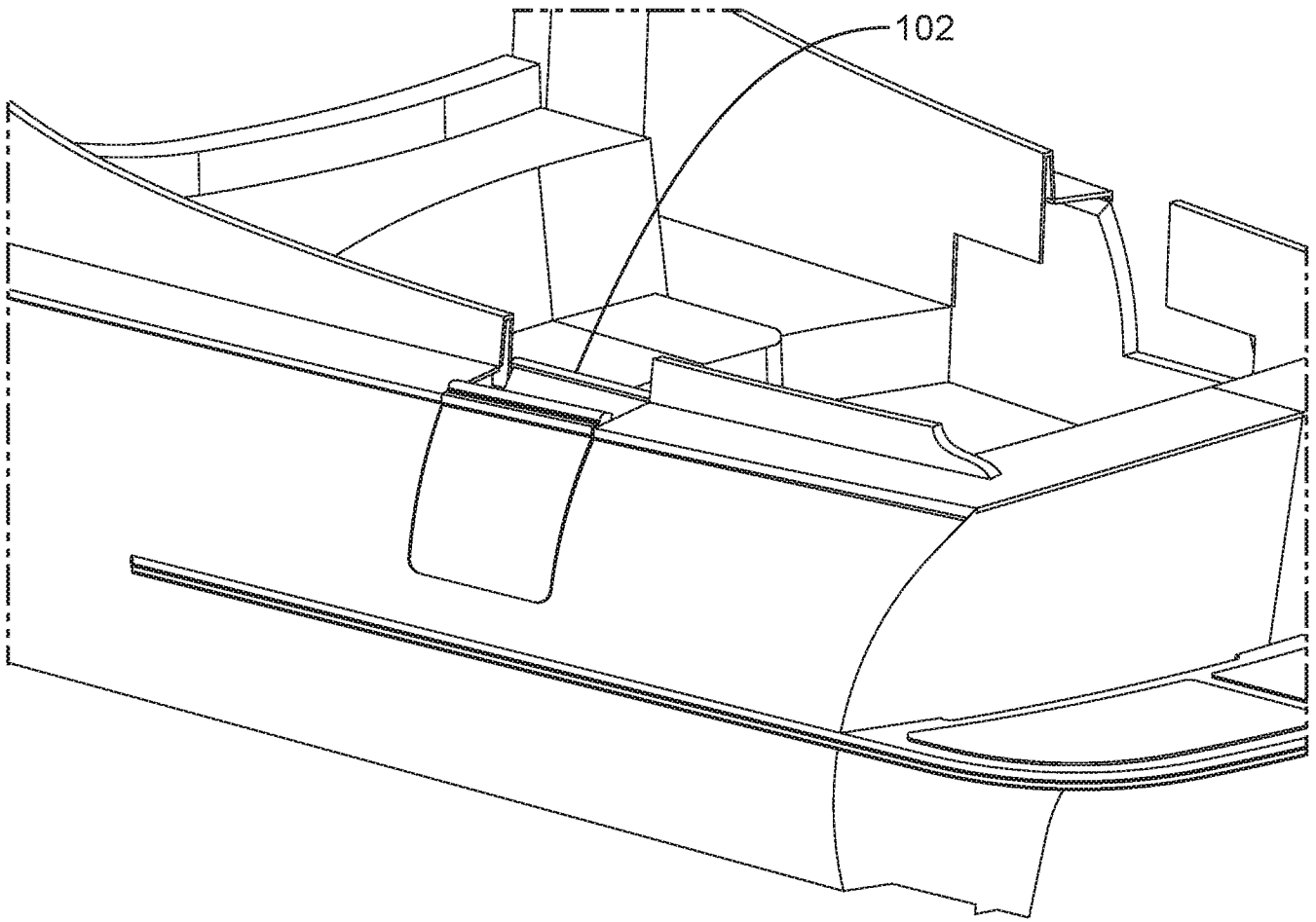
FIG. 23 is an aerial port perspective view from outside the vessel according to an embodiment of the present invention.
Figure 24:
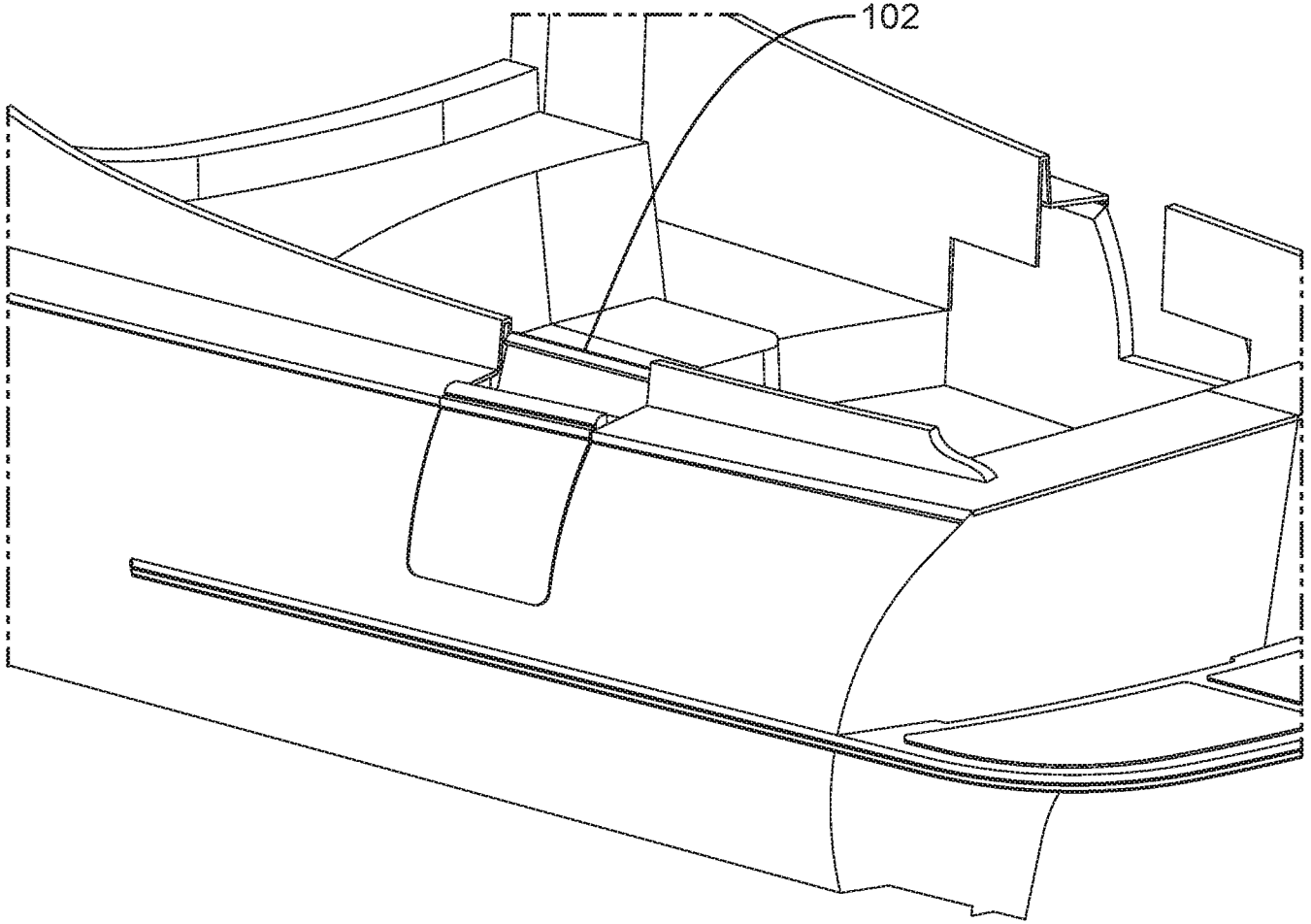
FIG. 24 is an aerial port perspective view from outside the vessel according to an embodiment of the present invention.
Figure 25:
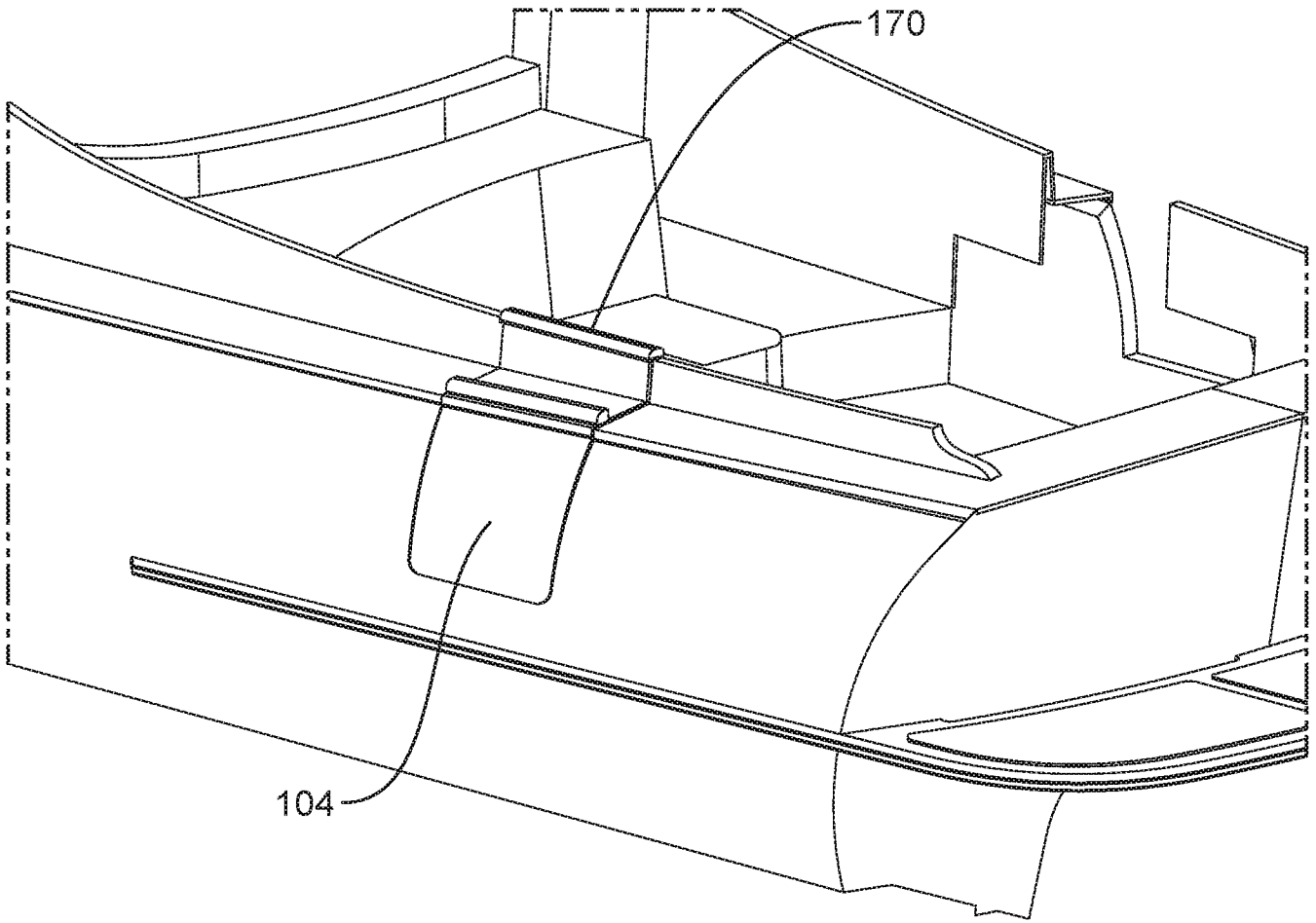
FIG. 25 is an aerial port perspective view from outside the vessel according to an embodiment of the present invention.

As shown in FIG. 15, the bottom edge of the door portion 104 may have a shaped ram 502 for lifting the step part 116*b* during the closing process and for allowing the step part 116*b* to fall gently into position when opened.

FIGS. 14-20 illustrate the sliding of the door portion into the closed position, as viewed from outside of the boat, according to an embodiment of the present invention. FIGS. 21-25 illustrate rotation of the gunwale portion 102 back into its normal position.

The recess may be exposed to sea and weather and therefore should be sufficiently sealed and provided with drains, either overboard or into the cockpit of the vessel.

The preferred embodiment of the invention is configured to be adapted in certain models of HINCKLEY YACHT'S powerboats. According to embodiments, the gunwale portion 102 includes a running board, or wash guard, as part of a raised coming and therefore, has an L-shaped cross-section. The recess accordingly, as an L-shaped opening for receiving the gunwale portion 102 after it has been rotated into position.

Materials and components to be used are preferably chosen from those suitable for marine environment. Electrical and electronic components are preferably 12 or 24 volts DC. Metal components are preferably stainless steel. The door step is preferably covered by or manufactured from a nonskid material, such as treaded teak, hard or soft non-skid fiberglass or plastic.

It will be readily apparent to those skilled in the art that other suitable modifications and adaptations of the rotating and sliding boat boarding door assemblies and systems and methods of the invention described herein are obvious and may be made using suitable equivalents without departing from the scope of the invention or the embodiments disclosed herein.

For example, the door assembly could be divided into more than two components and/or detachably coupled in order to accommodate different geometries. The gunwale portion can be rotated more or less based on its cross-section, to reduce the size of the recess in the hull 108. The door assembly could be provided transom of the vessel as well.

As shown, the door assembly preferably slides forward, because boats typically taper running aft and therefore, there is less room for the recess approaching the stern of the vessel. However, the invention is not limited to which direction the door slides.

A commercial embodiment of the invention utilizes a wireless switch for wireless actuation of the door via a remote, such as a key fob, for example, from MARINCO. Other means for actuating the door may be used, such as toggle switches, coupling the door controller with an onboard computer or network, etc.

What is claimed is:

1. A rotating and sliding boarding door assembly for a boat, comprising:

a door having a gunwale portion positioned in an opening in a gunwale of the boat when the assembly is in a closed position, and a hull portion positioned below said gunwale portion, said hull portion positioned in an opening in a hull side of the boat when the assembly is in the closed position;

a plurality of actuators coupled with said gunwale portion and said hull portion, said actuators being configured to rotate the gunwale portion toward an interior of the boat into a sliding position and to slide the gunwale portion and the hull portion into a recess in a hull of the boat when the gunwale portion is in the sliding position; and one or more tracks, slideably coupled with said gunwale portion and/or said door portion, for guiding said gunwale portion and said door portion into said recess;

where said gunwale portion and said hull portion are fully retracted into said recess when the assembly is in an open position such that a continuous opening in the topside of the boat is provided for boarding.

2. The boarding door assembly as recited in claim 1, further comprising a retractable recess cover to cover the recess in the hull when the door assembly is in a closed position.

3. The boarding door assembly as recited in claim 1, wherein said recess has an opening shaped to receive at least said gunwale portion.

4. The boarding door assembly as recited in claim 1, wherein said recess has an opening shaped to correspond to a cross-sectional shape of said gunwale portion.

5. The boarding door assembly as recited in claim 1, wherein said gunwale portion it rotatably coupled with said hull portion.

6. The boarding door assembly as recited in claim 1, further comprising a controller for controlling actuation of the actuators, wherein said actuators are electric, and said controller is configured to move said door between the closed position and the open position.

7. The boarding door assembly as recited in claim 6, wherein the controller may be remotely controlled by a wireless remote control.

8. The boarding door assembly as recited in claim 1, further including a step portion configured to cover an exposed portion of the hull opening when the door is in the open position and to rotate upward into the cockpit to allow the door to be moved into the closed position.

9. The boarding door assembly as recited in claim 8, further including a ram, positioned on a leading bottom edge of the hull portion, said ram being shaped to lift said step portion so that it rotates upward into the cockpit as the door moves into the closed position, and to lower said step portion to cover the exposed portion of the hull opening when the door moves to the open position.

10. The boarding door assembly as recited in claim 1, wherein said plurality of actuators includes a first linear actuator for rotating said gunwale portion, a second linear actuator for securing said gunwale portion when the door assembly is in the closed position by extending at least one pin into a recess in the hull, and a third actuator for sliding said door portion and said gunwale portion, together, into the recess.

11. A boat having a rotating and sliding boarding door assembly, comprising:

a hull having an opening in a side for boarding and at least one recess into the side of the hull in a side of the opening;

a door having a gunwale portion positioned in the top of opening when the door is in a closed position so as to form a portion of the top-deck and a a hull portion positioned below said gunwale portion, said hull portion positioned in the opening in the side of the hull when the door is in the closed position;

a plurality of actuators coupled with said gunwale portion and said hull portion, said actuators being configured to rotate the gunwale portion toward an interior of the boat into a sliding position and to slide the gunwale portion and the hull portion into a recess in a hull of the boat when the gunwale portion is in the sliding position; and one or more tracks, slideably coupled with said gunwale portion and/or said hull portion, for guiding said door into said recess;

where said gunwale portion and said door portion are fully retracted into said recess when the assembly is in an open position such that a continuous opening in the topside of the boat is provided for boarding.

12. The boat as recited in claim 11, further comprising a retractable recess cover to cover the recess in the hull when the door is in the closed position.

13. The boat as recited in claim 11, wherein said recess has an opening shaped to receive at least said gunwale portion.

14. The boat as recited in claim 11, wherein said recess has an opening shaped to correspond to a cross-sectional shape of said gunwale portion.

15. The boat as recited in claim 11, wherein said gunwale portion it rotatably coupled with said hull portion.

16. The boat as recited in claim 11, further comprising a controller for controlling actuation of the actuators, wherein said actuators are electric, and said controller is configured to move the door between the closed position and the open position.

17. The boat as recited in claim 16, wherein the controller may be remotely controlled by a wireless remote control.

18. The boat as recited in claim 11, further including a step portion configured to cover an exposed portion of the hull opening when the door is in the open position and to rotate upward into the cockpit to allow the door to be moved into the closed position.

19. The boat as recited in claim 18, further including a ram, positioned on a leading bottom edge of the hull portion, said ram being shaped to lift said step portion so that it rotates upward into the cockpit as the door moves into the closed position, and to lower said step portion to cover the exposed portion of the hull opening when the door moves to the open position.

20. The boat as recited in claim 11, wherein said plurality of actuators includes a first linear actuator for rotating said gunwale portion, a second linear actuator for securing said gunwale portion when the door is in the closed position by extending at least one pin into a recess in the hull, and a third actuator for sliding said hull portion and said gunwale portion, together, into the recess.

21. The assembly as recited in claim 9, wherein the step portion includes a top layer of a nonskid material.

22. The boat as recited in claim 19, wherein the step portion includes a top layer of a nonskid material.

* * * * *